United States Patent [19]

Matsuyama

[11] Patent Number: 4,464,044

[45] Date of Patent: Aug. 7, 1984

[54] IMAGE FORMING APPARATUS

[75] Inventor: Kouzou Matsuyama, Yokohama, Japan

[73] Assignee: Tokyo Shibaura Denki Kabushiki Kaisha, Tokyo, Japan

[21] Appl. No.: 379,041

[22] Filed: May 17, 1982

[30] Foreign Application Priority Data

May 18, 1981 [JP] Japan ..... 56-74729

[51] Int. Cl.[3] ..... G03G 15/00

[52] U.S. Cl. ..... 355/14 R; 355/3 R; 355/14 C; 355/8

[58] Field of Search ..... 355/3 R, 14 R, 14 C, 355/8; 235/304, 304.1, 304.2

[56] References Cited

U.S. PATENT DOCUMENTS 4,162,396 7/1979 Howard et al. ..... 235/304

4,350,439 9/1982 Tanioka et al. ..... 355/14 SH

*Primary Examiner*—A. C. Prescott

*Attorney, Agent, or Firm*—Cushman, Darby & Cushman

[57] ABSTRACT

A copying apparatus is provided with a microprocessor having a memory storing programs for executing various diagnostic modes. When a combination check mode is designated by an operator selecting a combination of keys on the ten keys of a keyboard, the microprocessor causes two driving elements to operate, e.g., a motor for rotating a photoconductive drum and a clutch for moving a cleaning blade, both specified by the combination mode, the microprocessor then checking the combined operation of the motor and clutch.

7 Claims, 35 Drawing Figures

FIG. 13

G1

| MODE | LAMP | SW |
|---|---|---|
| 10 | JAM | EXIT |
| | TOF | SHT |
| | TOE | SPMS |
| | CEMP | SHEND |
| 11 | JAM | TSTR |
| | TOF | PSTR |
| | TOE | TLMT |
| | CEMP | THOM |
| 12 | JAM | CEMP |
| | TOF | TOF |
| | TOE | TOE |
| | CEMP | KEYS |
| 13 | JAM | CON |
| | TOF | TIM |
| | TOE | CHK |
| | CEMP | |

G2

| MODE | OUT |
|---|---|
| 14 | EXP |
| 15 | HTR |
| 16 | HVT |
| 17 | CHT |

G3

| MODE | OUT |
|---|---|
| 21 | BSL |
| 22 | TSCL |
| 23 | TBCL |
| 24 | PFSL |
| 25 | PSSL |
| 26 | SHSL |
| 27 | HSL |

G4

| MODE | OUT | OUT |
|---|---|---|
| 30 | MOT | |
| 31 | MOT | BSL |
| 32 | MOT | TSCL |
| 33 | MOT | TBCL |
| 34 | MOT | PFSL |
| 35 | MOT | PSSL |
| 36 | MOT | SHSL |
| 37 | MOT | HSL |

| MODE | FUNCTION | | | | |
|---|---|---|---|---|---|
| 40 | TONER IMAGE PRODUCTION | AFTER 0.05 | Sec | MOT | OFF |
| 41 | TONER IMAGE PRODUCTION | AFTER 0.1 | Sec | MOT | OFF |
| 42 | TONER IMAGE PRODUCTION | AFTER 0.2 | Sec | MOT | OFF |
| 43 | TONER IMAGE PRODUCTION | AFTER 0.3 | Sec | MOT | OFF |
| 44 | TONER IMAGE PRODUCTION | AFTER 0.4 | Sec | MOT | OFF |
| 45 | TONER IMAGE PRODUCTION | AFTER 0.5 | Sec | MOT | OFF |

FIG. 20
| MODE | FUNCTION | |
|---|---|---|
| 50 | PAPER FEED START TIMING | START FROM STARTING OF DOCUMENT TABLE. |
| 51 | PAPER FEED START TIMING | START AFTER 100m sec. FROM "ON" OF P-STR-SW |
| 52 | PAPER FEED START TIMING | START AFTER 200m sec. FROM "ON" OF P-STR-SW |
| 53 | PAPER FEED START TIMING | START AFTER 300m sec. FROM "ON" OF P-STR-SW |
| 54 | PAPER FEED START TIMING | START AFTER 400m sec. FROM "ON" OF P-STR-SW |
FIG. 21A
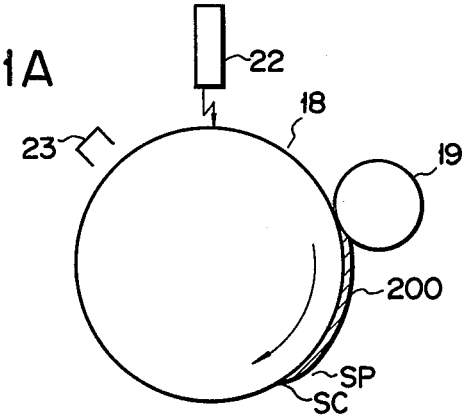
FIG. 21B
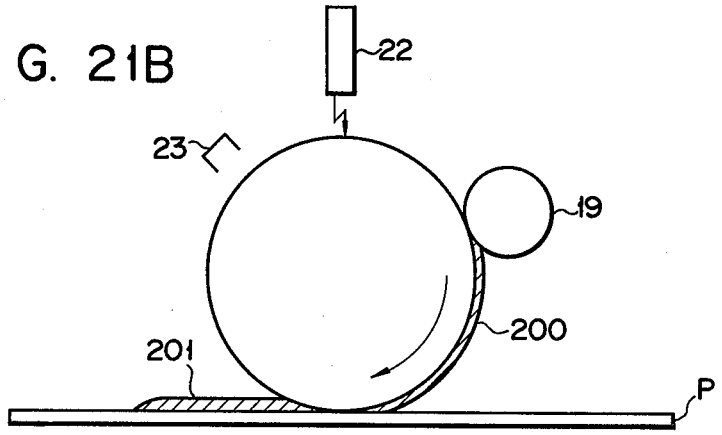

IMAGE FORMING APPARATUS

BACKGROUND OF THE INVENTION

The present invention relates to an image forming apparatus and, more particularly, to an image forming apparatus having a self-diagnostic function.

A conventional electrophotographic copying apparatus has a function notifying a user of a trouble with a special code so as to improve the serviceability when a fault occurs during a copying operation. However, this code indication merely informs, for example, of a failure of a document holding plate driving device but does not individually advise the content of the trouble, e.g., the trouble of a driving motor, failure of a driving clutch, etc. Therefore, a serviceman must shoot the position of the fault by employing a measuring instrument, e.g., a circuit tester and the like and accordingly has complicated check and maintenance.

SUMMARY OF THE INVENTION

It is an object of the present invention to provide an image forming apparatus having a self-diagnostic function of checking the operation by a simple external manipulation so as to improve the working efficiency of a serviceman or an assembling worker.

According to the present invention, there is provided an image forming apparatus comprising a document holding table for holding a document, a photoconductive drum, a charger for charging the photoconductive drum, an exposure unit for exposing the charged photoconductive drum corrspondingly to the pattern of the document to form an electrostatic latent image on the photoconductive drum, and a developer for converting the latent image into a toner image, wherein a self-diagnosis mode is executed when a check switch for checking the operations of the respective sections and units is operated. This self-diagnosis mode is carried out in accordance with a program set in a microprocessor associated with the copy production apparatus, the result of the self-diagnosis is displayed on a display unit. The copy production apparatus has various switches for detecting the start position, the home position and the table limit position of the document holding table, the document holding table is controlled in the movement by the data generated in response to the operation of these switches.

The self-diagnosis mode includes a mode for checking the composite operation of the rotation of a motor and other actuating members, e.g., forward and backward clutches, a paper feeding solenoid, a paper resupplying solenoid, etc., thereby confirming the properiety of the concerned operations in the copy production apparatus.

BRIEF DESCRIPTION OF THE DRAWINGS

FIG. 13 is a view showing the self-diagnosis mode groups;

FIG. 20 is a view showing the mode group of the self-diagnosis mode for checking the state of the front and back image positions;

FIGS. 21A and 21B are views showing the transfer state when the self-diagnosis mode group in FIG. 20 is executed.

DETAILED DESCRIPTION OF THE PREFERRED EMBODIMENT

The present invention will now be described in more detail with reference to the accompanying drawings.

Figure 1:
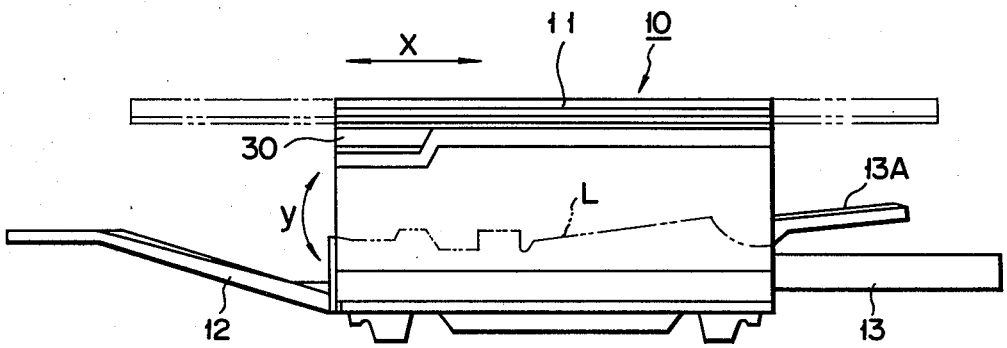
FIG. 1 is a side view of the copying apparatus according to one preferred embodiment of the present invention.
Figure 2:
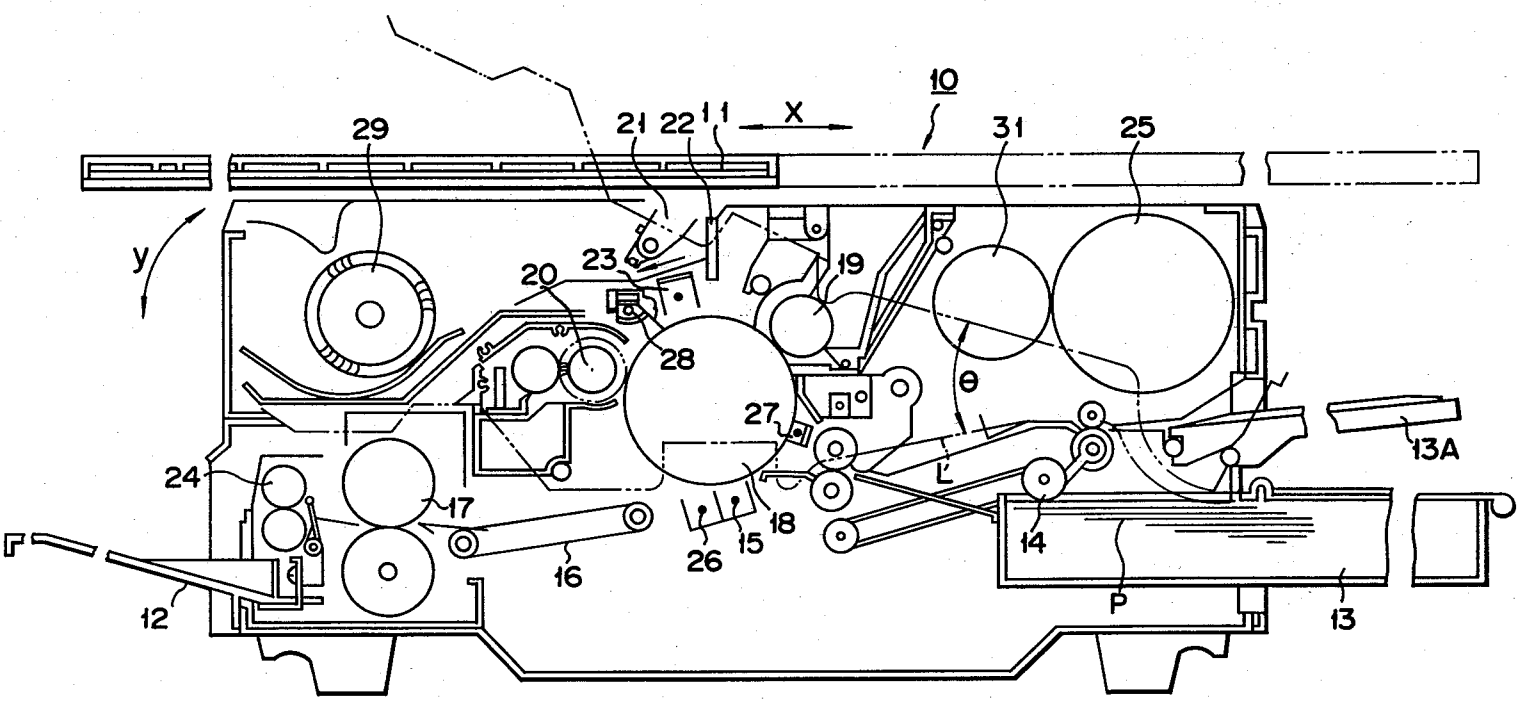
FIG. 2 is a view showing the internal construction of the copying apparatus shown in FIG. 1.

In FIG. 1, an image forming apparatus, i.e., an electrographic copying apparatus 10 comprises a document holding plate 11 disposed reciprocatingly movably in an X-direction and holding a document. In the copying apparatus 10 are provided a detachable tray 12 at the left side in FIG. 1, and a cassette 13 for containing copy sheets P and a different size copy sheet guide member 13A at the right side in FIG. 1. The guide member 13A is provided to guide a copy sheet of the size different from the copy sheets contained in the cassette 13. At the front of the cassette 13 and guide member 13A is arranged a copy sheet feeder 14 as shown in FIG. 2, which feeder 14 is constructed to feed a copy sheet P between a toner image transfer 15 and a photoconductive drum 18. The copy sheet P thus fed via the toner image transfer 15 is separated by an electrostatical separator 26 from the photoconductive drum 18, and is in turn fed by a sheet conveyer 16 into a fixing unit 17. The copy sheet P thus fed through the fixing unit 17 is sequentially fed out by a carrying roller 24 onto the tray 12. The roller 24 is constructed to rotate in synchronism with the movement of the document holding plate 11 and with the rotation of the photoconductive drum 18. There are sequentially arranged a cleaning device 20, a pre-exposing unit 28, a charger 23, a light guide 22 of an exposure system, a developer 19 and a discharger 27 in the rotating direction of the drum 18 in addition to the aforementioned transfer 15 and separator 26 around the photoconductive drum 18. The exposure system has an illuminator 21 for illuminating a document held by the document holding plate 11, and the illumination light reflected from the document is guided by the light guide 22 to the photoconductive drum 18. The document holding plate 11 is moved forwardly and backwardly in such a manner that the rotating force of a motor 25 is transmitted to the document holding plate 11 by a clutch 31. A fan 29 is provided to cool the heating section, e.g., the illuminator 21 and the fixing unit 17 of the copying apparatus. A no-sheet detector (e.g., a microswitch) is provided at the upper middle part of the cassette 13, and a paper jamming detector (e.g., a microswitch) is arranged at the left side in FIG. 2. According to the copying apparatus of the present invention, after an operating lever 30 is rotated to release the lock of an upper frame UF, the upper frame UF may be opened at a desired angle $\theta$ (e.g., 25°) in a direction of an arrow Y in FIG. 2. The paper jam occurred in the sheet transfer path can be readily removed by opening the upper frame UF. Above the copying apparatus 10 is movably mounted the document holding plate 11, for example, composed of a tempered glass plate as shown in FIG. 3 as will be described in greater detail. That is, the document holding plate 11 is engaged at its one side (at the rear in FIG. 3) slidably with the channel of a channel rail 33 integrally formed above one frame 32B and is mounted at the other side (at the front in FIG. 3) at a guide rail 35 slidably engaged with a guide rail 34 fixedly secured to the upper bent part of the other frame 32A. A smooth slide member 36 is inserted into the channel of the channel rail 34. Inverted L-shaped fitting brackets 37, 37 are fixed secured to the side of the guide rail 35, and the document holding plate 11 is supported at the other side between the fitting brackets 37, 37 and the guide rail 35.

A document holding plate driving device 101 is provided at the guide rail 35 side in the copying apparatus 10. This document holding plate driving device 101 has a drive source and hence a motor 25 contained within the copying apparatus 10. This motor 25 is connected by a belt to an electromagnetic clutch 31. A pulley 38 projected from the frame 32A is mounted on the rotating shaft of the clutch 31. This pulley 38 is engaged with a pulley 39 projected from the frame 32A in the vicinity of the bottom of the document holding plate 11 by means of a belt. A drive cable 41 mounted via a spring between the fitting brackets 37, 37 is wound by one turn on the pulley 39. When the motor 25 is rotated, the driving force of the motor is converted by the electromagnetic clutch 31 into the force for moving forwardly or backwardly the document holding plate 11 and is thus transmitted via the pulley 39 to the drive cable.

Figure 3A:
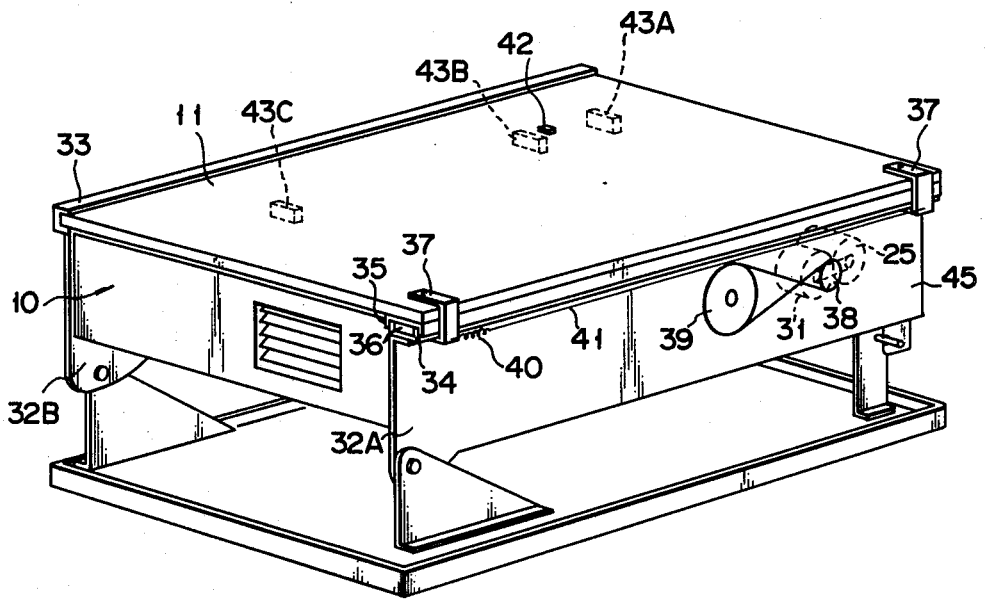
FIG. 3A is a perspective view of the copying apparatus in FIG. 1.

A document holding plate position detecting device will now be described in more detail with reference to FIGS. 3A and 3B. A magnet 42 is mounted at an adequate position on the back surface of the document holding plate 11, at the position slightly right side from the middle part of the plate 11 in this embodiment, and three reed switches 43A, 43B and 43C are mounted at a predetermined interval on the lower part of the upper cover of the copying apparatus 10. Signals generated in response to the operations of the respective reed switches 43A to 43C will be inputted into a control section, which will be described in greater detail and will be utilized for control signals for the document holding plate driving device or for control signals for the copy sheet feeding unit.

Figure 3B:
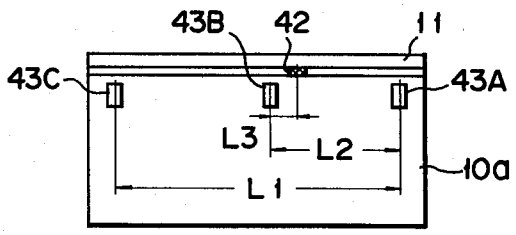
FIG. 3B is a schematic side view of the positioning switches in the arrangement of the copying apparatus.

The magnet 42 and the reed switches 43A to 43C are arranged on the same line, and the intervals between the reed switches 43A to 43C and the magnet 42 are set as shown in FIG. 3B. More particularly, the distance L1 between the reed switches 43A and 43C at both ends is set slightly longer than the length of the document of the maximum size (e.g., A3 or B4 size) in the longitudinal direction, and the distance L2 between the right side reed switch 43A and the middle reed switch 43B is set slightly longer than the length of the document of the minimum size (e.g., B5 size) in the longitudinal direction. The magnet 42 is so provided at the position (stopping position) where the body 10*a* of the copying apparatus 10 is completely superposed with the document holding plate 11 as to be retained at the position displaced by the distance L3 slightly in the leftward direction in FIG. 3B from the position of the middle reed switch 43B. The right side reed switch 43A is used as a movement starting position detecting switch and hence a table start switch, and the central reed switch 43B is used as a stopping position detecting switch and hence a table home switch. The left side reed switch 43C is used as a critical movement point detecting switch and hence a table limit switch.

Figure 4:
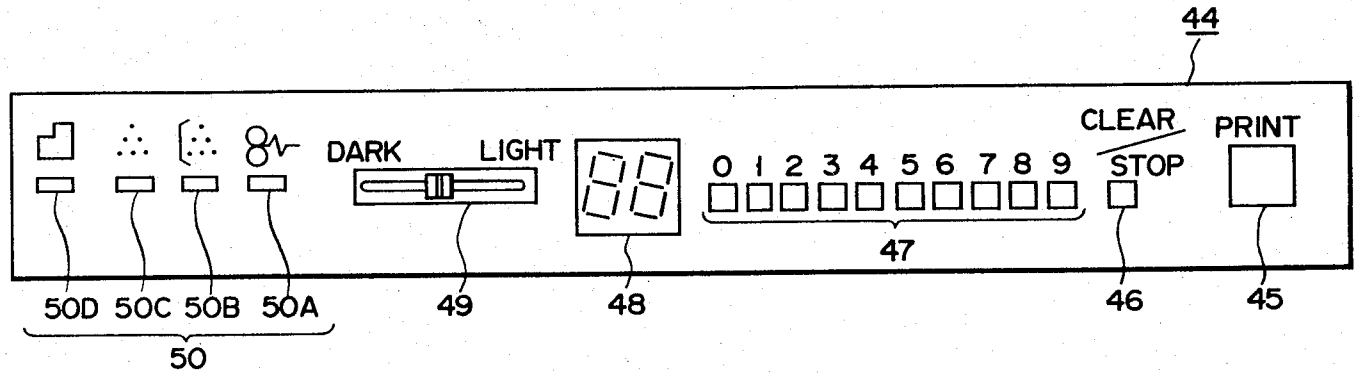
FIG. 4 is a plan view of the keyboard of the copying apparatus in FIG. 1.

An operation panel 44 as shown in FIG. 4 is provided on the upper front side surface of the copying apparatus 10. On the operation panel 44 are provided a print switch 45, a clear key 46 for correcting the number of copy sheets or for instructing the stopping operation, number-of-copy sheet setting ten keys 47, a number-of-copy sheet indicator 48, a document density control slide volume 49, and a copying apparatus operating state display section 50. The display section 50 includes a paper jam display 50A, a cleaner cleaning display 50B, a toner resupplying display 50C and a paper resupplying display 50D.

Figure 5A:
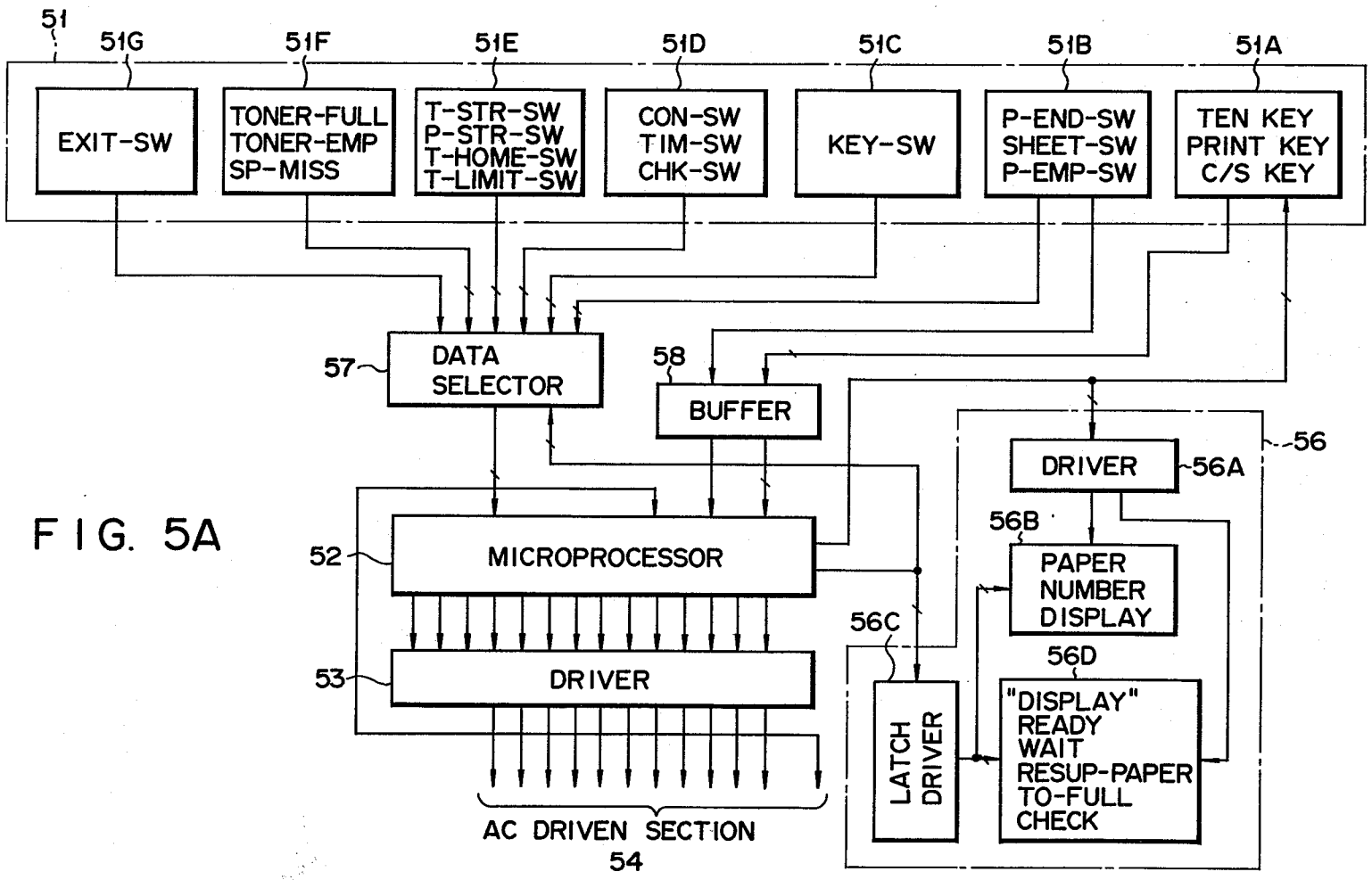
FIGS. 5A and 5B are a block diagram of the copying apparatus in FIG. 1.
Figure 5B:
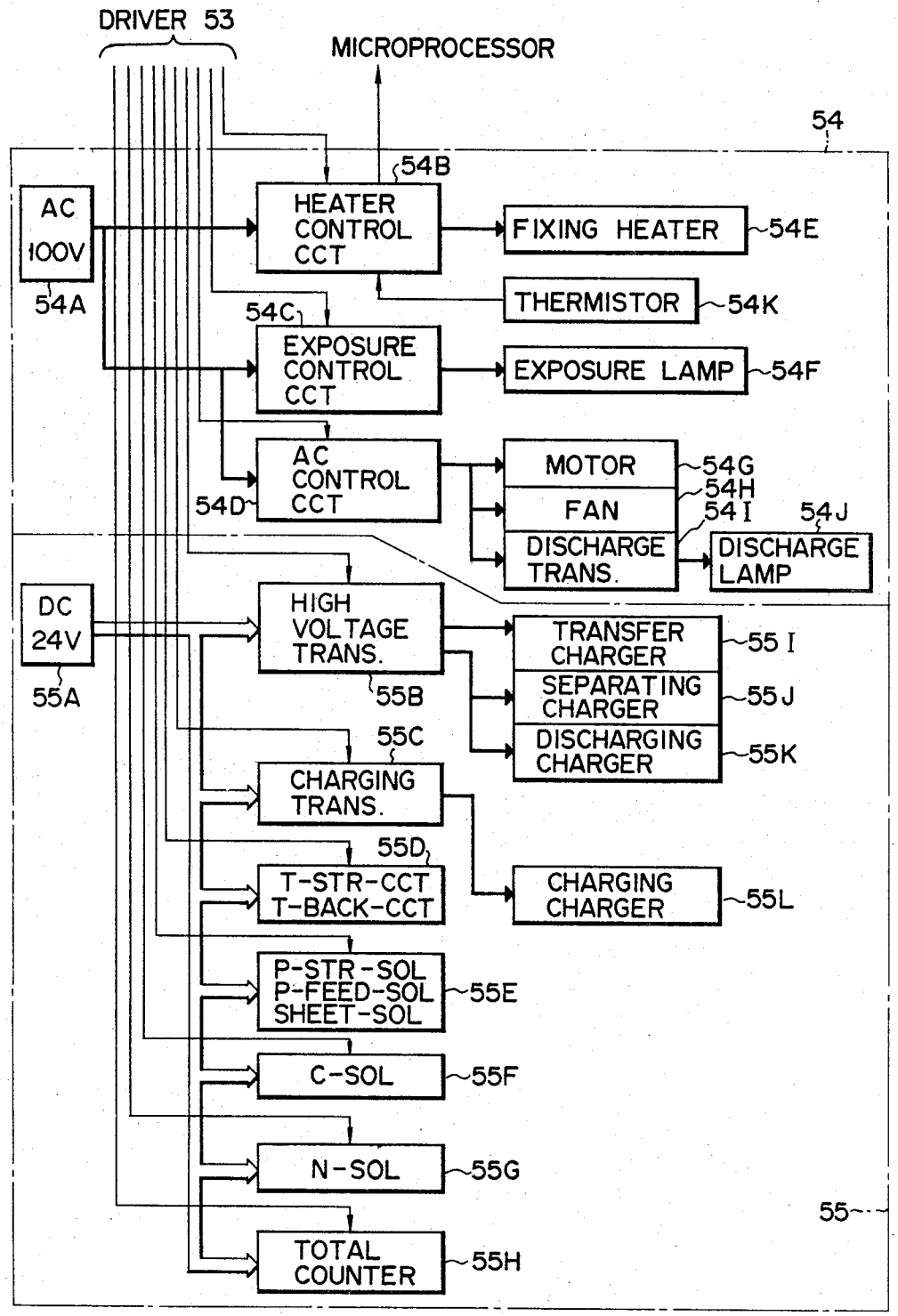
Figure 6A:
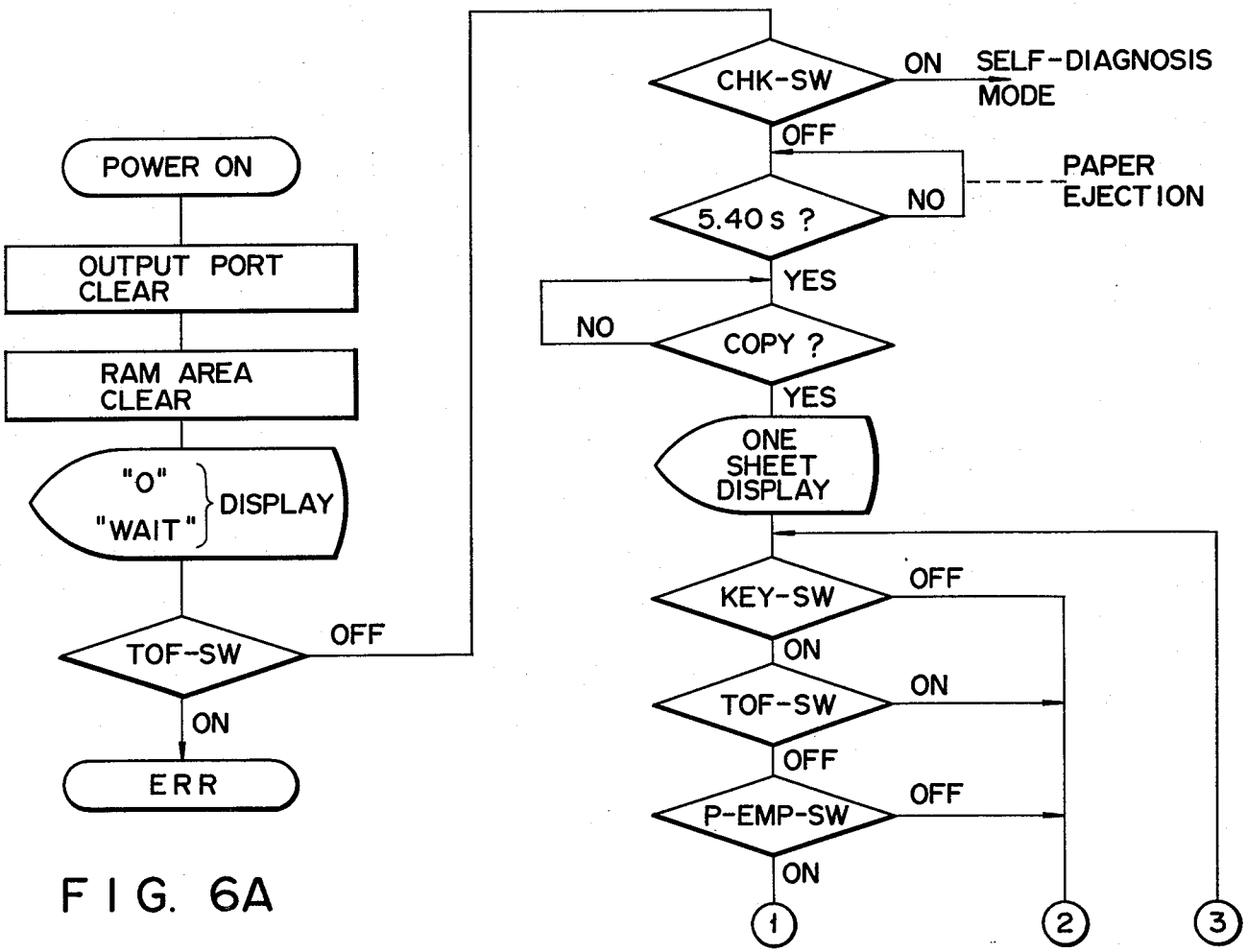
FIG. 6A to 10B are views showing the flow charts for explaining the operation of the copying apparatus in FIG. 1.
Figure 6B:
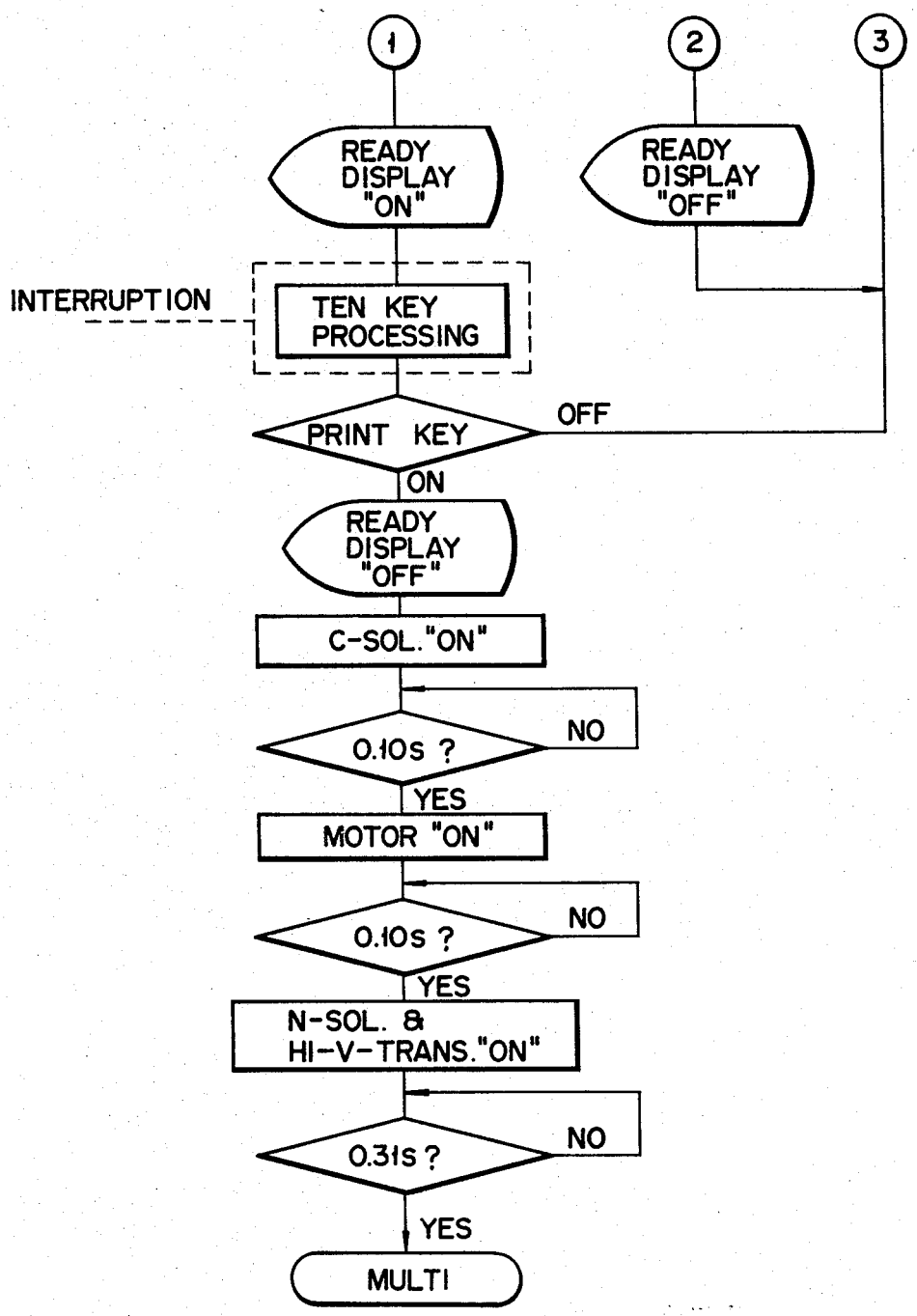
Figure 7A:
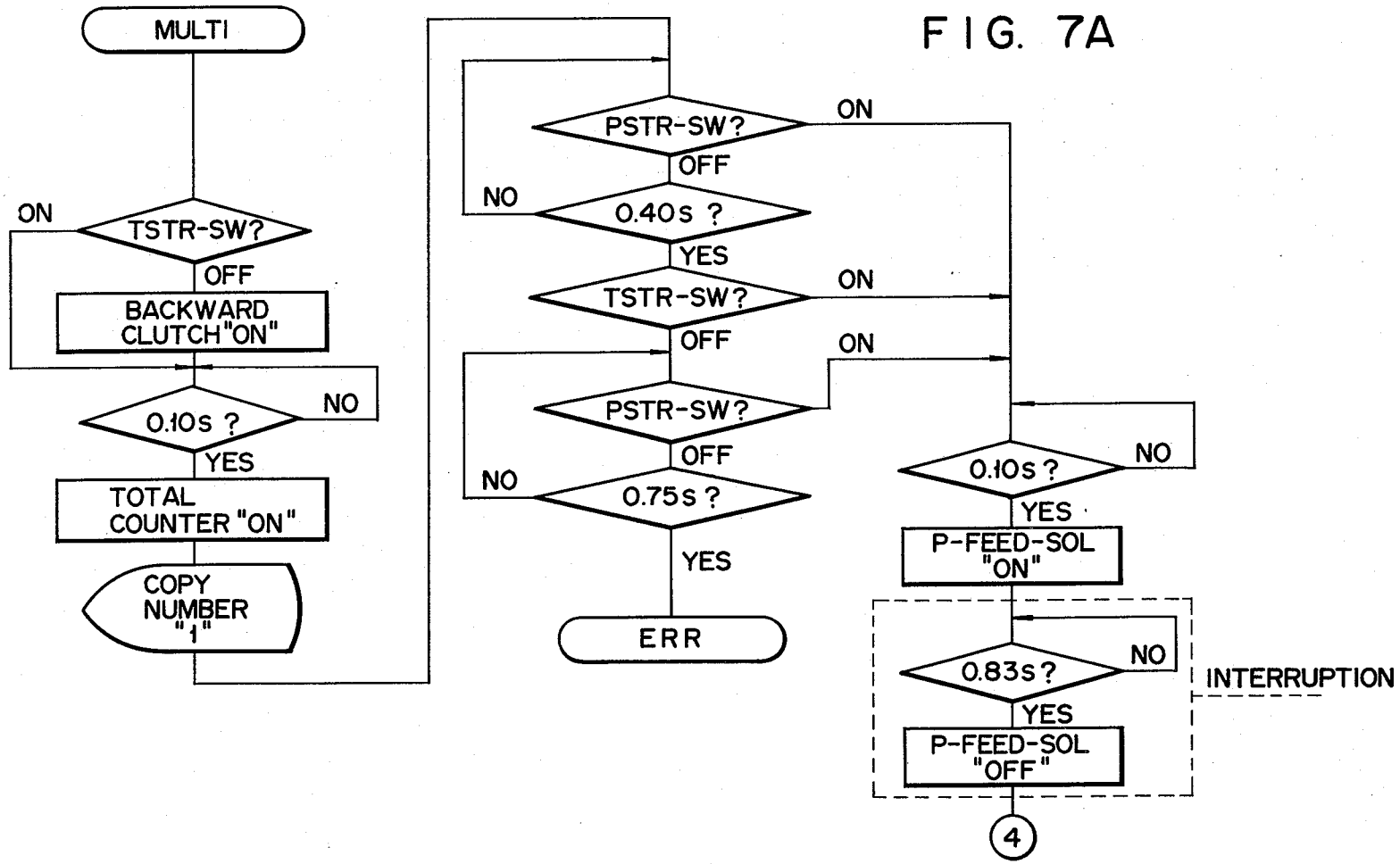
Figure 7B:
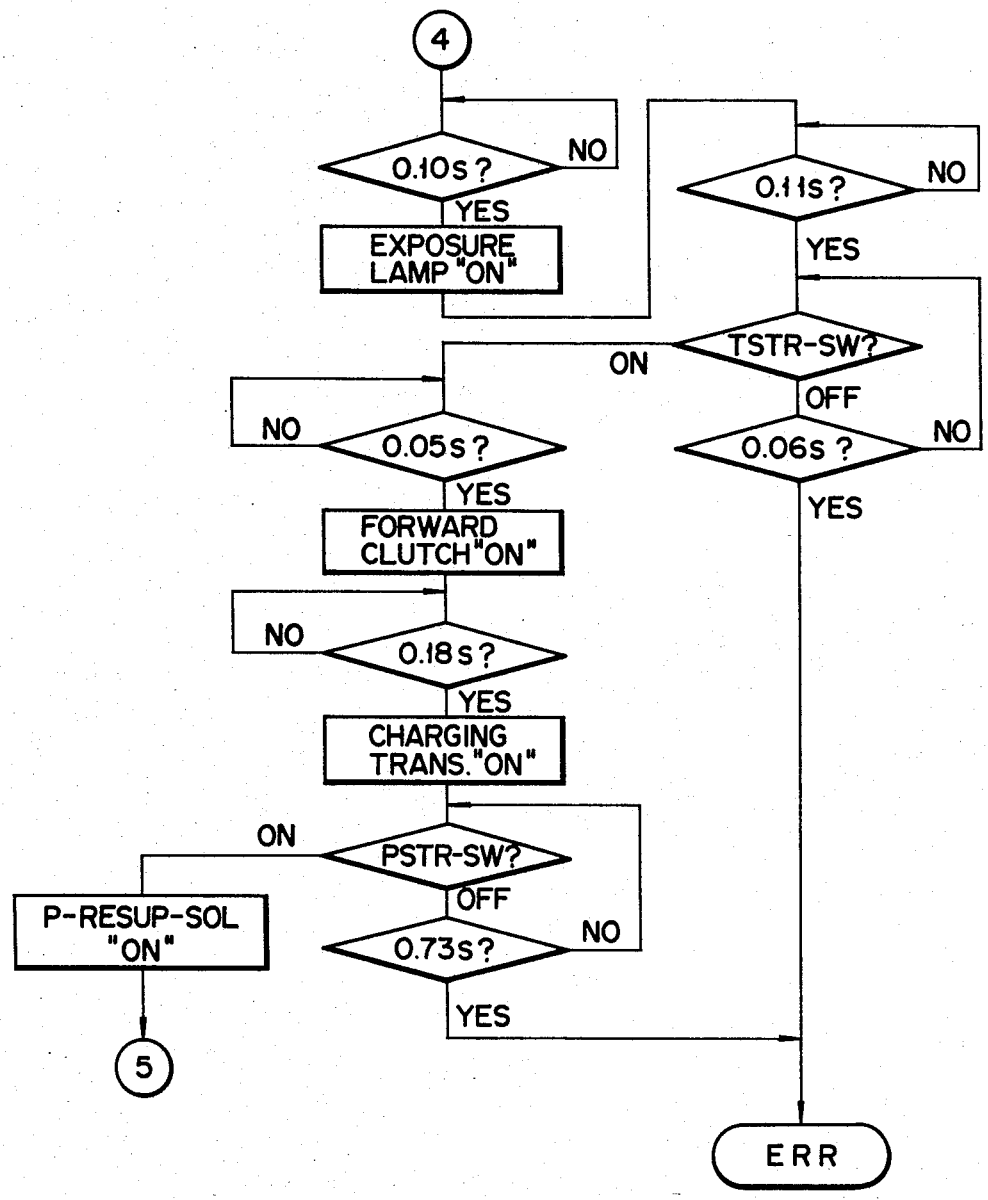
Figure 8A:
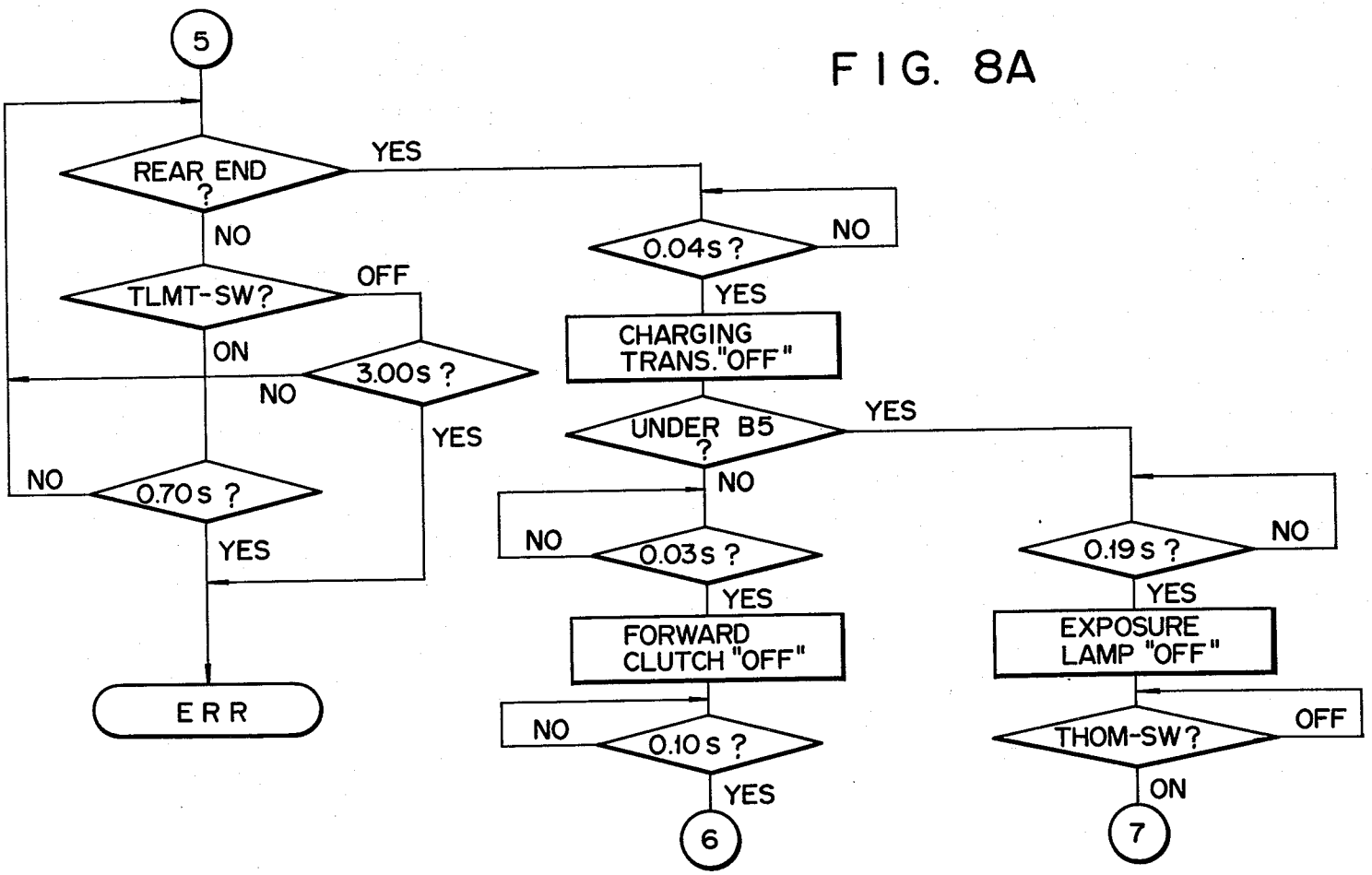
Figure 8B:
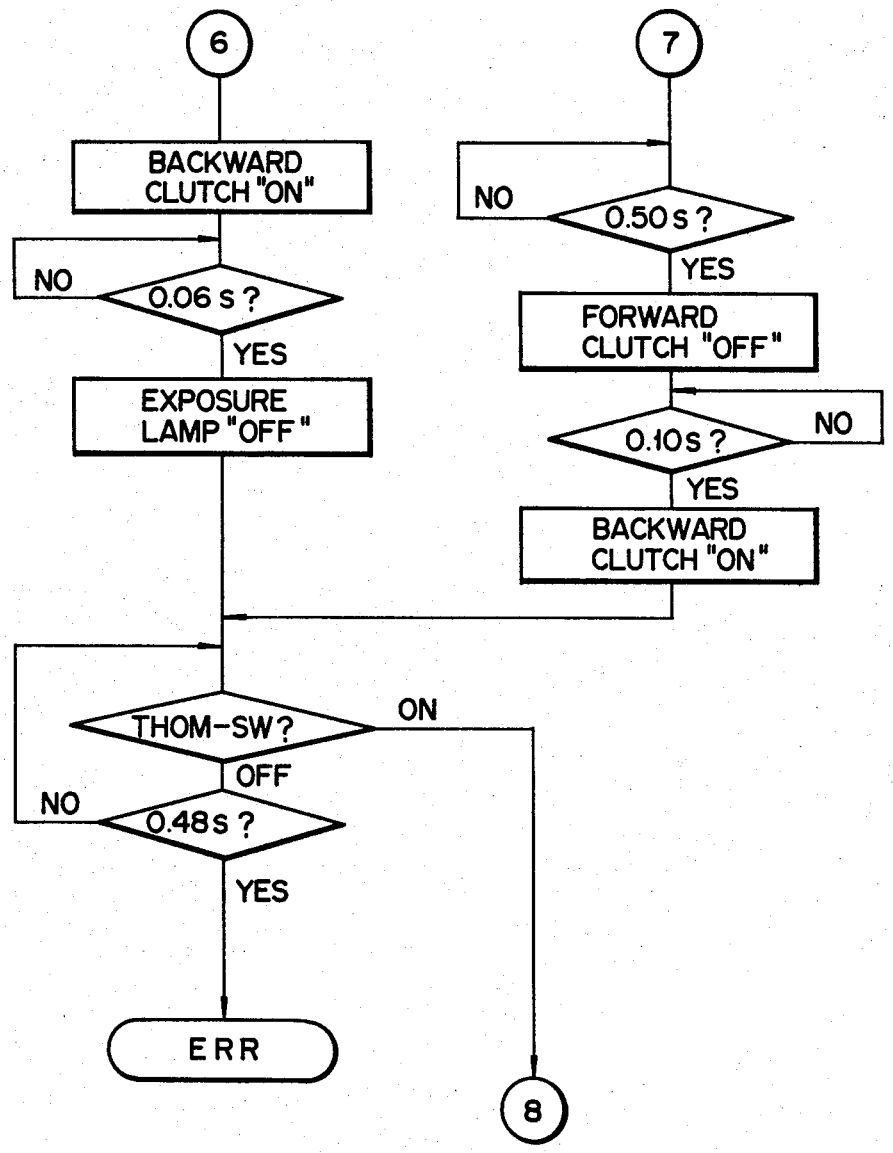

FIG. 5 shows a block diagram of the control system of the copying apparatus. In this control system, a switch unit 51 is connected through a data selector 57 and a buffer 58 to a microprocessor 52. The microprocessor 52 is connected through a driver 53 to an AC driven section 54 and a DC driven section 55. The AC driven section has components driven by AC 100V as will be described in greater detail, and the DC driven section 55 has components driven by DC 24V. A display unit 56 is connected to the switch unit 51 and the microprocessor 52 to display the operating states of the respective units and sections of the copying apparatus.

The switch unit 51 has a plurality of switch sections 51A to 51G. The switch section 51A has ten keys, a print key and a clear/stop (C/S) key. The switch section 51B has a paper feeding switch section which has a paper end switch (P-END), a sheet switch (SH-SW), a sheet empty switch (SH-EMP-SW) and a paper empty switch (E-EMP-SW). The switch section 51C has key switches. The switch section 51D is a mode selection switch section which has an ageing switch (CON-SW), a timer switch (TIM-SW) and a check switch (CHK-SW). In the document holding plate position detecting switch section 51E are provided the table start switch (T-STR-SW) 43A, the paper start switch (P-STR-SW), the table home switch (T-HOME-SW) 43B and the table limit switch (T-LIMIT-SW) 43C. The photoconductive drum peripheral switch section 51F has a toner-full switch (TONER-FULL-SW) and a toner-empty switch (TONER-EMP-SW). The transport switch section 51G has a paper ejecting or paper exit switch (EXIT-SW) for detecting the exhaust of the copy paper.

The AC driven section 54 is provided with an AC power supply 54A, which is connected to a heater control circuit 54B, an exposure control circuit 54C and an AC control circuit 54D to energize the circuits 54B to 54D. The heater control circuit 54B is connected to the fixing heater 54E to control the heater current to the fixing heater 54E in response to the output of a thermistor 54K. The exposure control circuit 44C is connected to an exposure lamp 54F. The AC control circuit 54D is connected to a motor 54G, a line flow fan 54H and a discharging transformer 54I, which is connected to a cleaning lamp 54J.

In the DC drive section 55, a DC power supply 55A is connected to a high voltage transformer 55B, a charger transformer 55C, a document holding plate driving device 55D, a paper feeding solenoid 55E, a clear solenoid 55F, a fixing solenoid 55G and a total counter 55H at their power supply terminals. The high voltage transformer 55B is connected to a transferring charger 55I, a separating charger 55J and a discharging charger 55K. The charger transformer 55C is connected to a charging charger 55L.

In the display unit 56 is provided a driver 56A connected to the operation switch section 51A and the microprocessor 52. The output terminal of the driver 56A is connected to a paper number display 56B and an operation display 56D. The output terminal of a latch drive 56C is connected to the displays 56B and 56D. The latch driver 56C receives data from the microprocessor 52 to drive the displays 56B and 56D. The operation display 56B displays the operation status of the copying apparatus, e.g., ready, wait, paper-resupplying, etc.

The operation of the copying apparatus thus constructed will now be described with reference to the flow charts in FIGS. 6A to 10B and the moving positions of the document holding plate in FIG. 11. When the power source is closed ON, the output port of the microprocessor 52 and the RAM are cleared. At this time the paper number display 48 displays "00" and the operation display 56D displays "WAIT". At this time ON or OFF of the cleaner cleaning switch is judged, when ON is judged, an error "ERR" is displayed, while when OFF is judged, ON or OFF of the check switch (which is a serviceman switch mounted in the copying apparatus) is judged. When this check switch is ON, a flow of self-diagnosis mode is executed. When the check switch is OFF, a conventional copying process is executed. When 5.40 sec. is elapsed from the energization of the copying process in this case, the copy enable "READY" is judged, and "1" is displayed in the copy number display 56B to indicate one sheet. Then, the key counter switch (KEY-SW), the cleaner cleaning switch (TOF-SW) and the paper empty switch (P-EMP-SW) are checked, and when these switches are switched to unpreferable states, the "READY" lamp remains in the deenergized state, and when all the switches are preferable states, the "READY" lamp is energized. When the copy number is set by the ten keys 47 in this state and the print key is then depressed, the copying operation will start. When the print key is depressed in this state, the "READY" lamp is deenergized, and the cleaner solenoid is energized. The motor is rotated after 0.1 sec. thereafter, and when 0.1 sec. is elapsed from the rotation of the motor, the fixing solenoid and the high voltage transformer are energized. When 0.31 sec. is further elapsed, the copying apparatus is transferred to the multi-copying flow in FIGS. 7A and 7B.

Figure 11A:
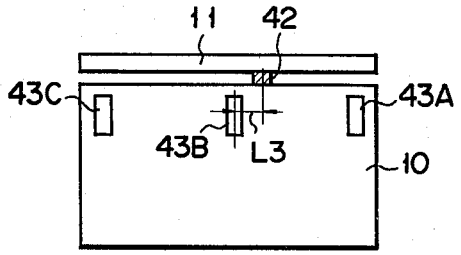
FIGS. 11A to 11E are schematic side views of the copying apparatus showing the moving states of the document holding plate.
Figure 11B:
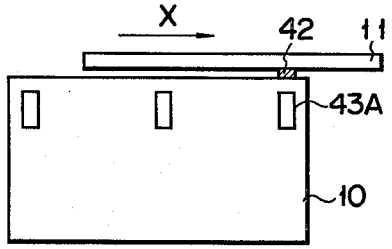
Figure 11C:
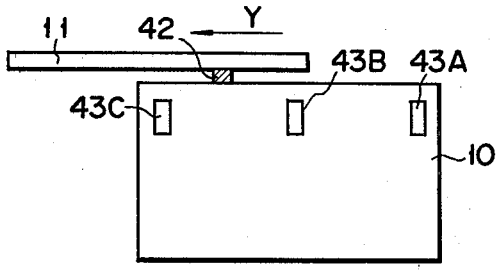

In the multi-copying flow, whether or not the table start switch (T-STR-SW) is OFF is first judged. When the switch is OFF, the backward clutch for retarding the document holding plate is actuated. When the document holding plate 11 is disposed at the center of the copying apparatus 10 at this time, the table start switch is judged, since the magnet 42 is not disposed on the start reed switch 43A, to be OFF. Thus, the backward operation clutch is operated, and the document holding plate 11 is retarded in a direction of an arrow X. The document holding plate 11 is stopped at the position (i.e., start position) shown in FIG. 11B. On the other hand, when the document holding plate 11 is already disposed at the position to close the start position reed switch 43A, the aforementioned table backwarding step is not executed, but the operation is advanced to the next process by one step. When 0.1 sec. is elapsed from the start of the document holding plate 11, the total counter starts counting and subtracts by one from the set copy number. The subtracted result is displayed on the copy number display 48. Whether or not the paper start switch (P-STR-SW) is ON is judged at this stage. When the paper start switch is OFF, whether or not the table start switch is ON is judged after 0.4 sec. When the stable start switch is OFF, an error (ERR) display is executed after 0.75 sec. When the table start switch and the paper start switch are both ON, the paper feeding solenoid is energized after 0.1 sec. and the paper feeding device is operated to execute the paper feeding. After 0.83 sec. from the energization of the paper feeding solenoid the paper feeding solenoid is deenergized to thus complete the paper feeding. After 0.1 sec. from the end of the paper feeding, the exposure lamp is energized to start the exposure. After 0.11 sec. from the start of the exposure whether or not the table start switch is ON is judged again. When the table start switch is judged to be OFF, an error (ERR) is displayed after 0.06 sec. When the table start switch is judged to be ON, the forward clutch for forwarding the documents holding plate is energized after 0.05 sec. to forward the document holding plate 11 in a direction of the arrow Y as shown in FIG. 11C. After 0.18 sec. from the start of the document holding plate 11, the charging transformer is energized to execute the charging. Then, whether or not the paper start switch is ON is judged, when it is ON, the paper feeding solenoid is energized to conduct the paper feeding. Thereafter, the copying apparatus is operated in accordance with the flow charts in FIGS. 8A and 8B. When the OFF of the paper start switch is detected at this time, an error (ERR) display is executed after 0.73 sec. from this point.

Figure 11D:
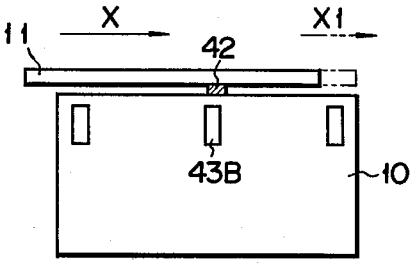
Figure 11E:
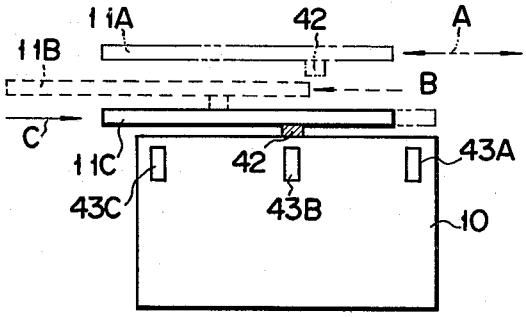
Figure 12:
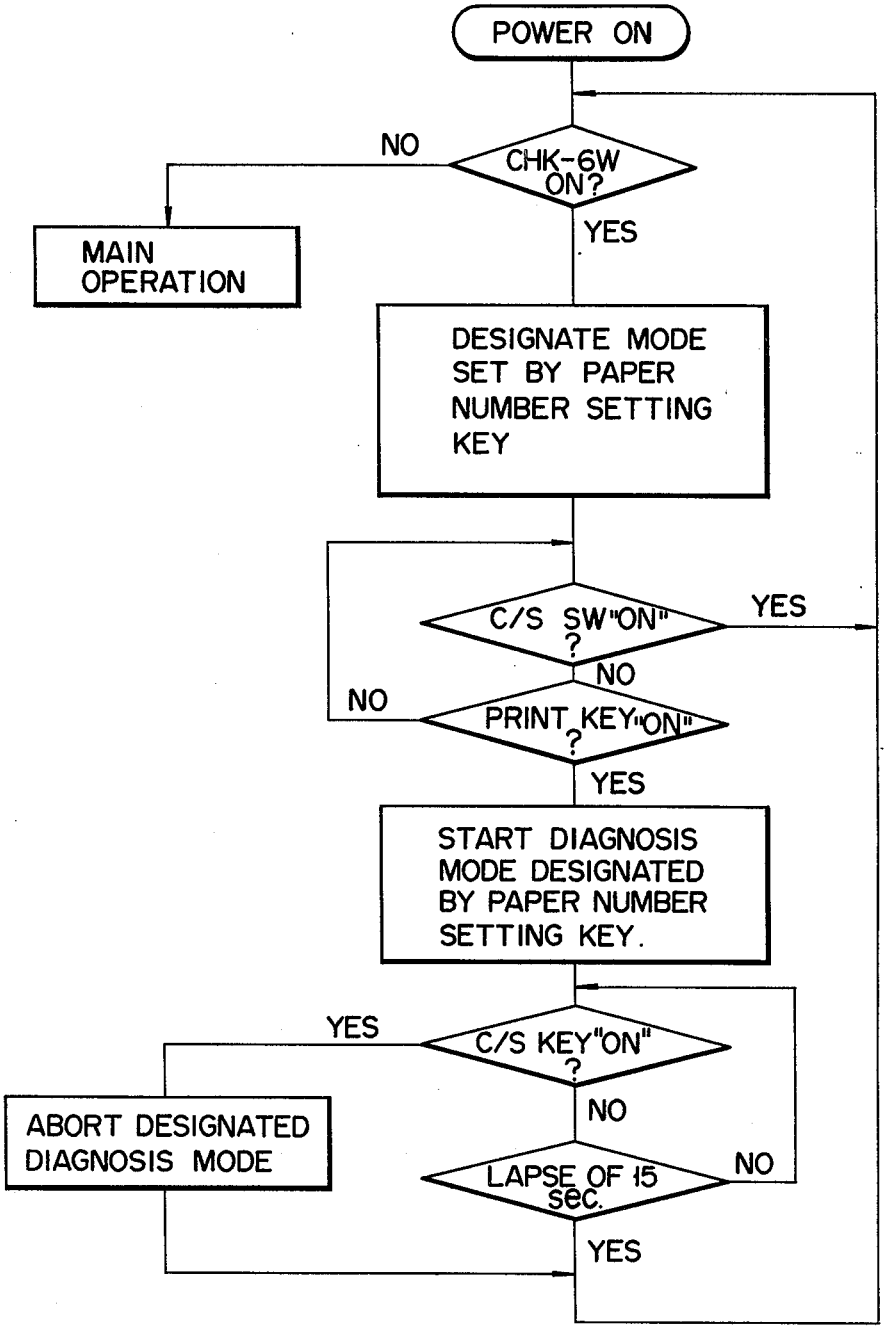
FIG. 12 is a view showing the flow chart of the self-diagnosis mode.
Figure 14A:
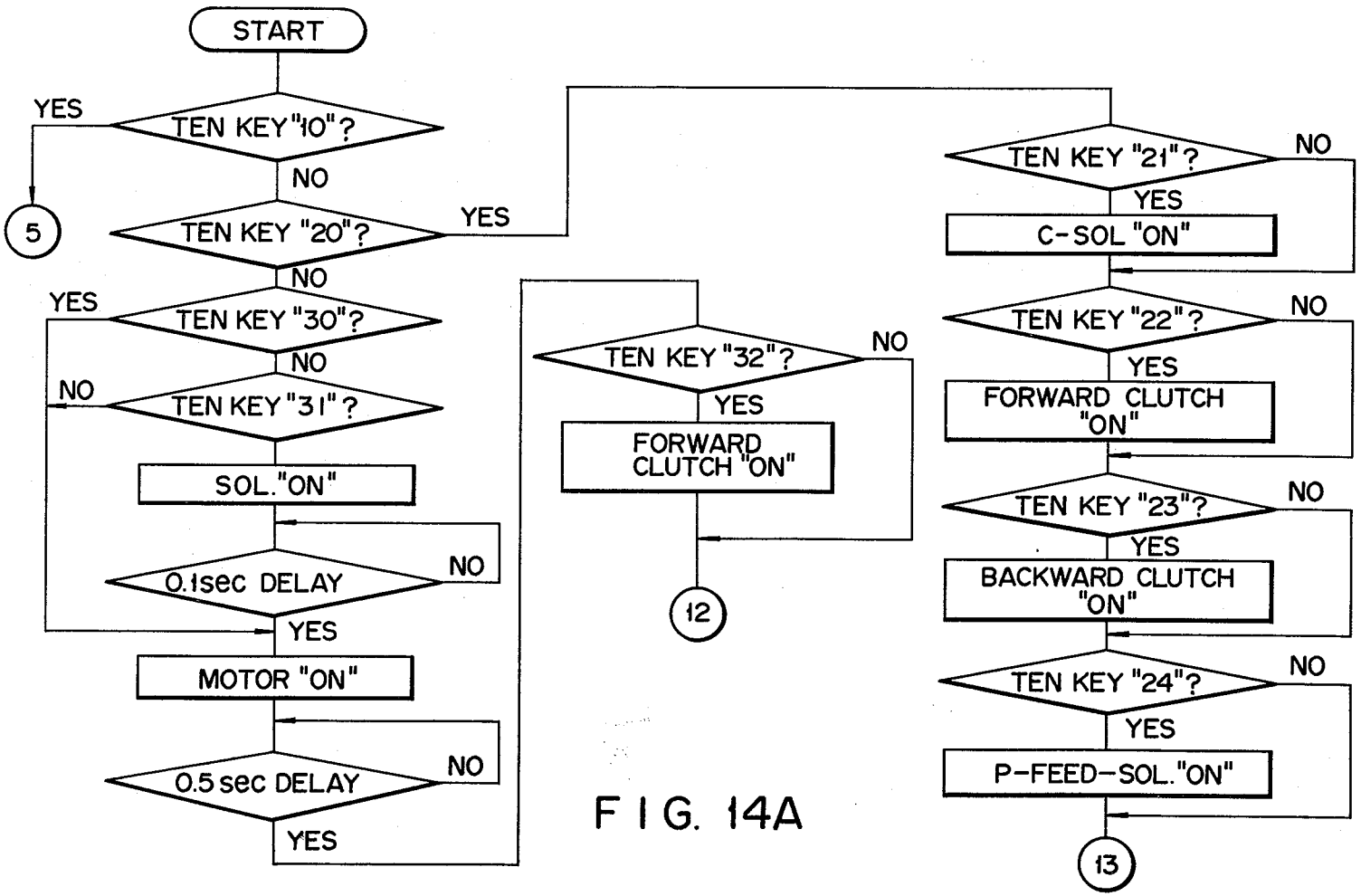
FIGS. 14A to 16 are flow chart showing the self-diagnosis operation in accordance with the self-diagnosis mode groups in FIG. 13.
Figure 14B:
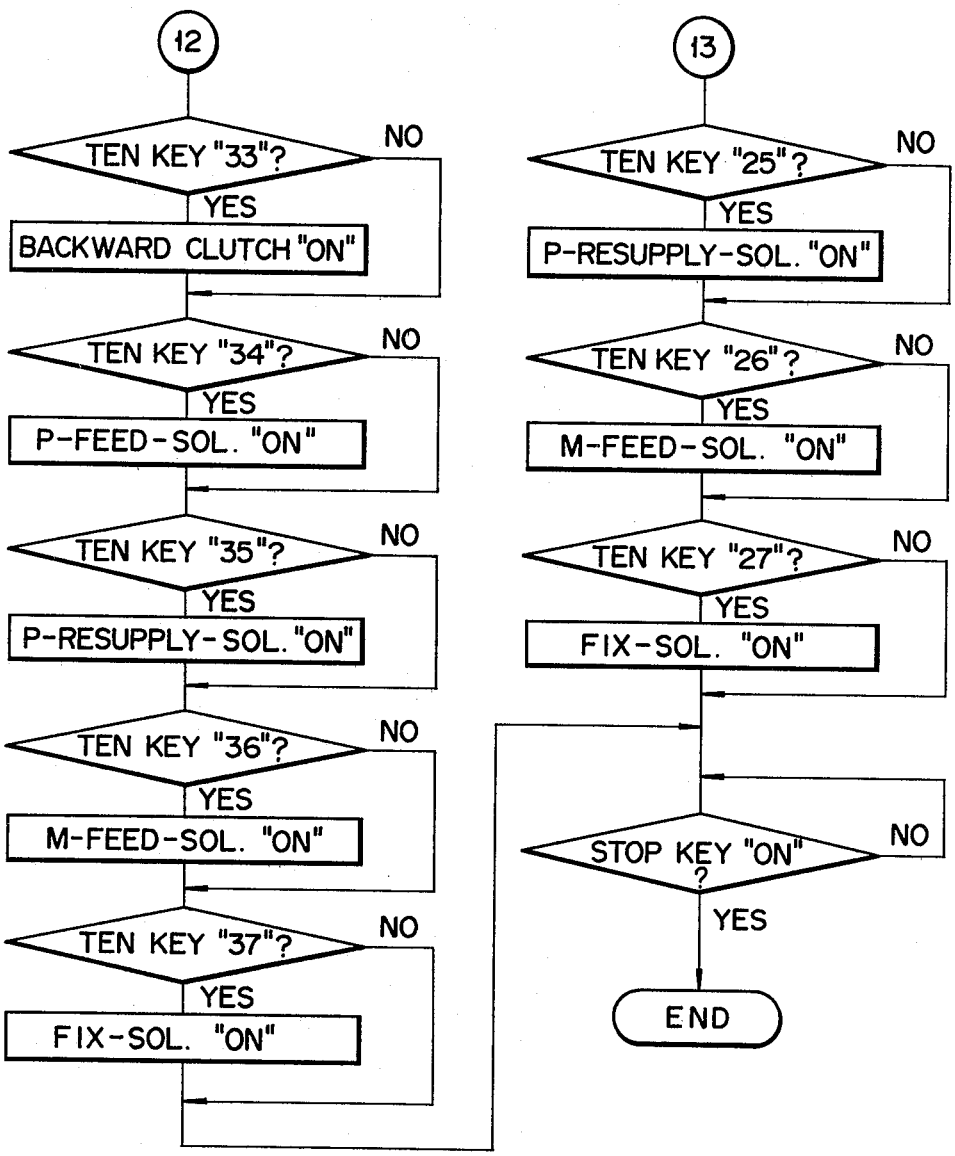

When the paper end is detected by the paper end detecting switch in the paper feeding, the charging transformer is deenergized after 0.04 sec. from the detection to finish the charging. When the paper end detecting switch is OFF at this time, the document holding plate 11 remains forwarding. When the magnet 42 reaches the limit position reed switch 43C and thus closes the reed switch 43C ON, an error (ERR) is displayed after 0.7 sec. from the ON of the limit switch 43C. When the switch 43C is OFF, an error (ERR) is displayed after 3 sec. from the detection of the OFF. When the aforementioned charging transformer is deenergized, whether or not the document size is less than B5 size is judged, when it is judged to be not less than B5 size, the clutch is deenergized after 0.03 sec. from the judgment to stop forwarding of the document holding plate 11. The clutch for backwarding the document holding plate 11 is energized after 0.1 sec. from the stop. Thus, the document holding plate 11 is backwarded in the X direction as shown in FIG. 11D. The exposure lamp is deenergized after 0.06 sec. from the start of the operation of the clutch. When the document holding plate 11 continues backwarding and the magnet 42 reaches the home position switch 43C as shown in FIG.

11D, the home position switch 43B becomes ON. When the ON of the switch 43B is detected, the copying apparatus is forwarded to the flow in FIG. 9. When the switch 43B does not become ON due to a trouble, an error display is executed after 0.4 sec. from when the magnet 42 reaches the position of the reed switch 43B.

Figure 9:
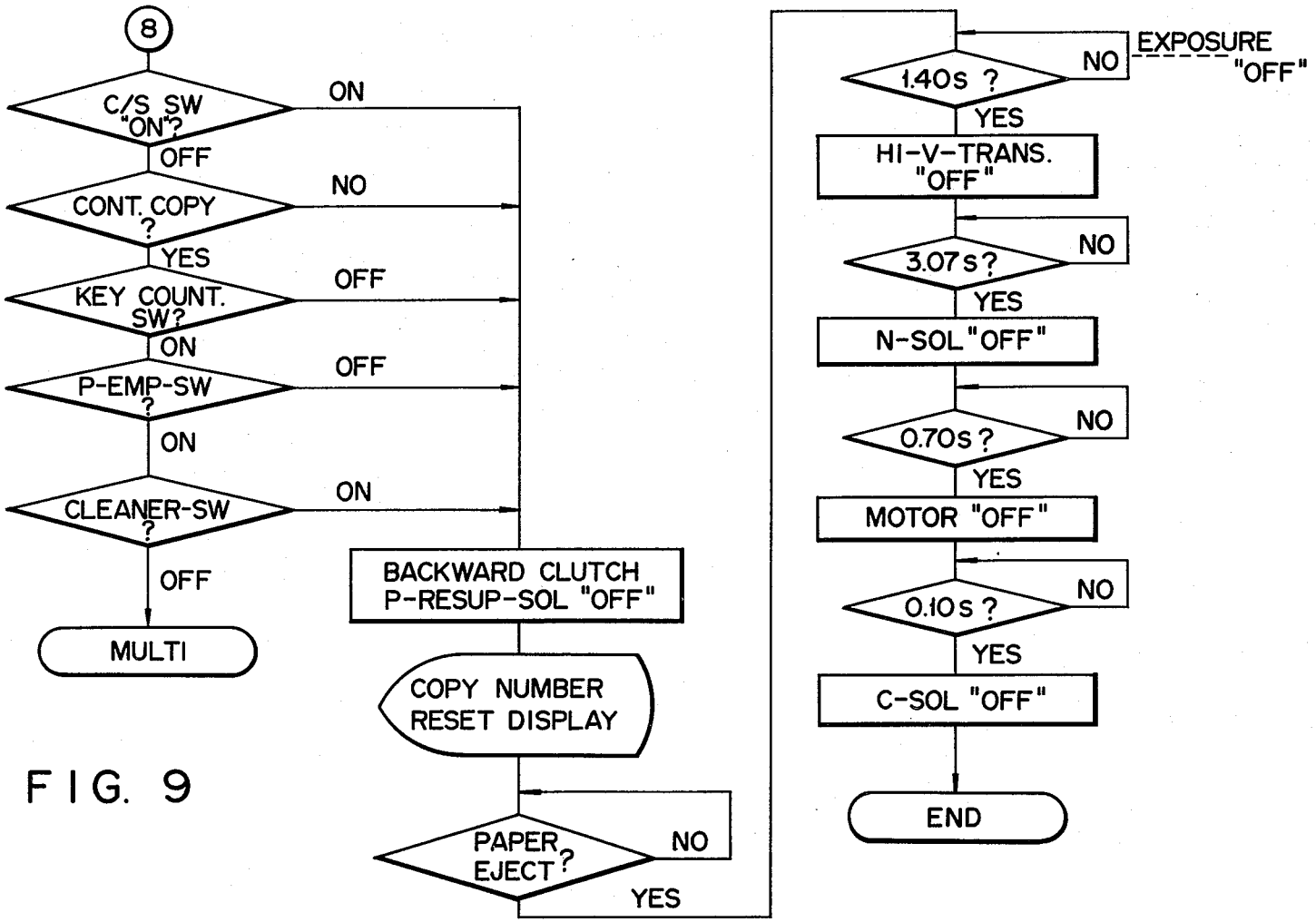
Figure 10A:
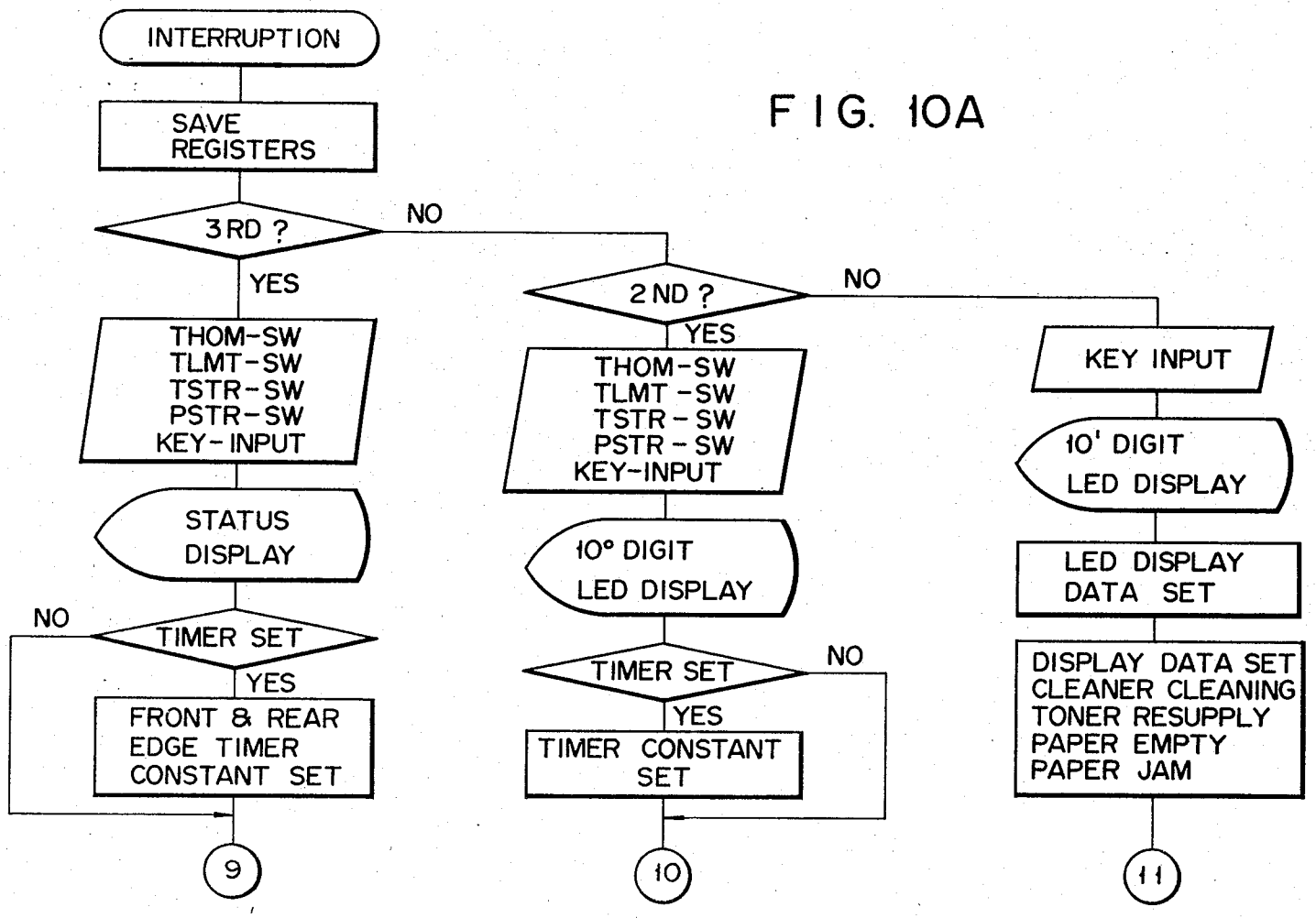
Figure 10B:
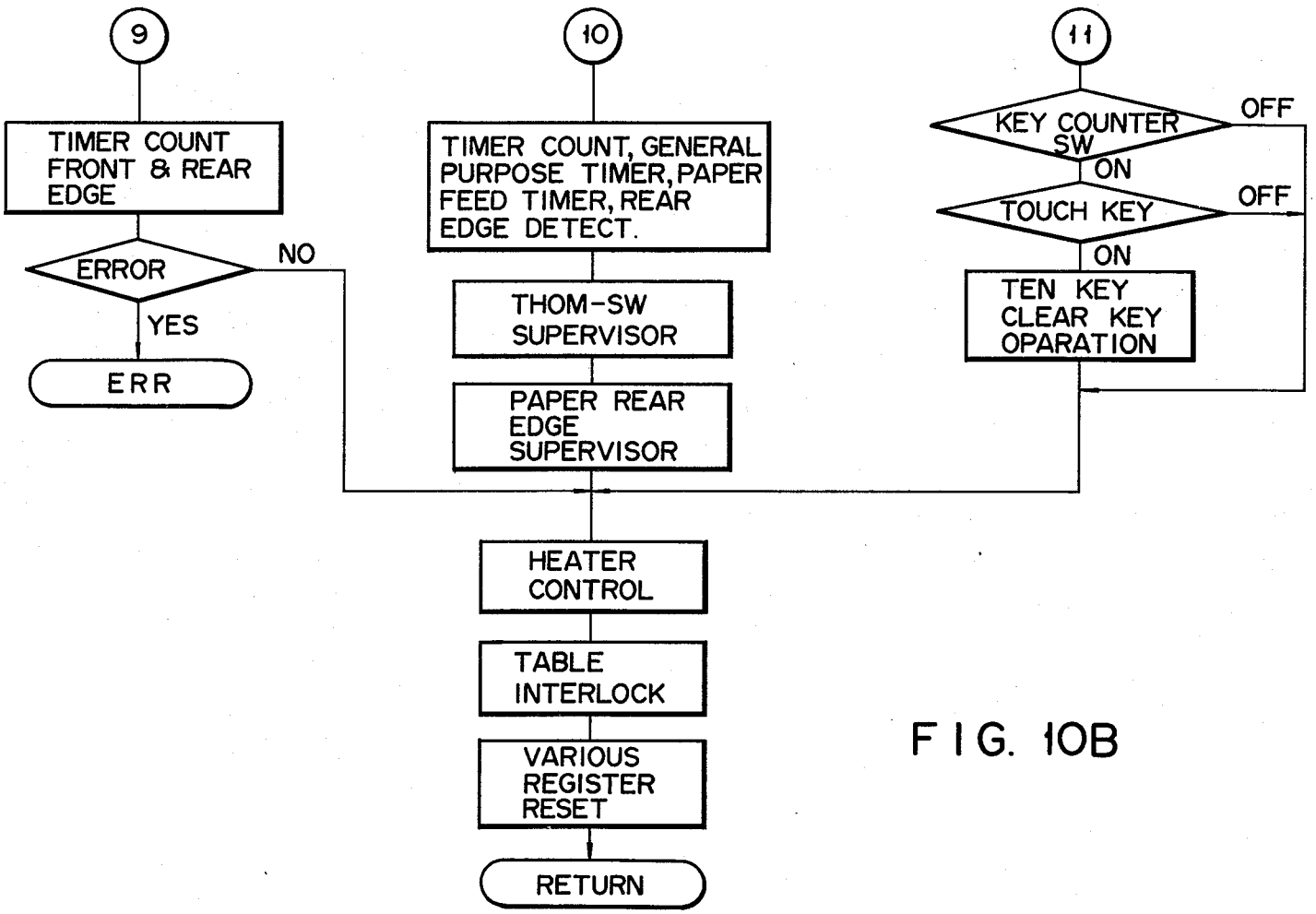

In the flow in FIG. 9, whether or not the clear/stop key is ON is judged, when the key is OFF, the copy operation is judged to be continuous copy mode. When it is the continuous copy mode, whether or not the key counter switch is ON is judged. When the key counter switch is ON, whether or not the paper empty switch is ON is judged. When the cleaner cleaning switch is OFF, the operation of the copying apparatus is returned to the "MULTI"-flow in FIGS. 7A and 7B. The copying apparatus will operate in accordance with the next flow when the clear/stop key is ON, when it is not the continuous copy mode, when the key counter switch is off, when the paper empty switch is OFF or when the cleaner cleaning switch is ON. In the next flow, the backward clutch and the paper feeding solenoid are both deenergized. Since the backward clutch is deenergized at the position where the backwarding document holding plate 11 is disposed at the position shown in FIG. 11D, i.e., where the magnet 42 coincides with the reed switch 43B in this case, the plate driving device is stopped, but the document holding plate 11 is further backwarded by the inertial force, is overrun at the distance L3 in the X1 direction as shown by a dash line, and is thus stopped. This distance L3 was approx. 50 mm when the document holding plate 11 was backwarded, for example, at 300 mm/sec. It is preferred from this fact that the distance L3 is set at 50 mm between the magnet 42 and the home position switch 43B in FIG. 11A. When the position of the document holding plate 11 in FIG. 11A is at home position and the plate is disposed at this position, the copy number is reset to the set number on the copy number display 48. Thereafter, whether or not the paper ejecting is finished is judged, the high voltage transformer is deenergized after 1.4 sec. from the end of the paper ejecting. The fixing solenoid is deenergized after 3.07 sec. from the deenergization of the high voltage transformer, the motor is further stopped after 0.7 sec. therefrom, and the cleaner solenoid is deenergized after 0.1 sec. therefrom. Thus, a series of copying processes are finished.

In the positioning of the document holding plate, when the document size is, for example, small size, e.g., B5 size, the document holding plate 11 is reciprocated at the shorter distance corresponding to the small size so as to enhance the efficiency of the continuous copying. Accordingly, there occurs a difficulty in the positioning of the document holding plate. For instance, when the magnet 42 of the document holding plate 11A is reciprocated as indicated by an arrow A between the switches 43A and 43B as designated by two-dotted chain line in FIG. 11E, since, even if the document holding plate 11A is intended to be stopped at the home position by the above-described operation, the backwarding acceleration is not added to the document holding plate, the document holding plate is not overrun. Thus, the document holding plate is stopped at the position displaced from the home position. In order to eliminate such difficulty, a process shown in the flow in FIG. 8 is provided in the copying apparatus. More particularly, when the document size is judged to be less than the B5 size, the exposure lamp is deenergized after 0.19 sec. from the end of the copy of the last copy paper, the forward clutch is maintained in the energized state for a while to forward the document holding plate in a predetermined period. The time when the magnet 42 passes the table home position 43B is detected in the forwarding operation, and the forward clutch is deenergized after 0.5 sec. from the detection. Thus, the document holding plate 11 is stopped at the position indicated by a broken line 11B. The backward clutch is energized after 0.1 sec. from the stop of the document holding plate, and the document holding plate is backwarded in the direction of the arrow C. since the magnet 42 is arrived at the home position switch 43B in the state that sufficient acceleration is applied to the plate at the backwarding time, the document holding plate is overrun at the distance L3 due to the inertia even if the backward clutch is deenergized, and is then stopped. Accordingly, the document holding plate is always correctly stopped at the home position irrespective of the document size.

In the aforementioned copying apparatus, an interruption is executed at every predetermined period of time when the process is forwarded in accordance with the program so as to maintain the content of the program, and various data are reset. This interruption will now be described in more detail with reference to the flow charts in FIGS. 10A and 10B. In the flow charts, three interruptions are conducted at every predetermined period of time. When the interruption flow is executed, various registers are first saved, and whether or not the third interruption is effective is judged thereafter. When the third interruption is judged, various switches, e.g., THOM-SW, TLMT-SW, TSTR-SW, PSTR-SW and KEY-INPUT are operated, and the status display is executed. Then, whether or not the timer is set is judged, when the timer is set, the front end detection and back end detection timers are set at the predetermined constants. Whether or not there is an error in the counted content of the timer is judged, and when there is an error, the "ERR" display is executed. In the second interruption, the same process as the first interruption is conducted, but since it is impossible to set all the programs in the one interruption, the programs are assigned for the three interruptions, and the contents of all the programs are reset at the stage when the three interruptions are finished. In any case, the operation is returned to the main flow after restoring the heater control, table interlock and various registers.

The self-diagnostic mode will now be described in more detail with reference to FIGS. 12 to 16. According to the flow chart in FIG. 12, when the power source is closed ON, whether or not the check switch is ON or OFF is judged. When the check switch is ON, the self-diagnostic mode is set, and when the check switch is "OFF", the ordinary copying mode is executed. When the self-diagnosis ready state becomes effective, the "READY" lamp is energized, and the reception of the key information from the copy number setting key, the print key, and the clear/stop key becomes possible. "1" is displayed on the copy number display at this time. When the check switch is opened OFF in the self-diagnosis ready, the operation is returned to the ordinary copying mode. When the print key is depressed after the specified mode is set by the copy number setting key, the self-diagnosis is executed in accordance with the set mode. When the mode except the specified mode is set and the operation is started, the copy number display is not changed, but the copying apparatus becomes in the self-diagnosis ready. In this case, the clear/stop key is depressed, and the specified mode may be set again. When the self-diagnosis mode is executed, the clear/stop key is operated. At this time the self-diagnosis mode specified at previous time is released, and the operation is returned to the initial self-diagnosis ready. When the clear/stop key is not operated, the operation state depends upon the output port check or the input port check. More particularly, in the output port check, it is cleared so that the display becomes "1" after 15 sec. from the check (15 sec. clear), and the reception of the information from the copy number setting key and the print key becomes possible, but the current self-diagnosis mode is not released. In the input port check, the 15 sec. clear is not executed, but the diagnosis mode is released only by the clear/stop key.

The present self-diagnosis mode will now be described in more detail with reference to FIG. 13. This self-diagnosis mode is divided into four groups G1 to G4, the first group G1 indicates the modes for confirming whether nor not the various switches are normally operated, and the second group G2 indicates the modes for confirming the operation of various transformers. The third group G3 indicates the modes for confirming the operations of the various clutches and solenoids, and the fourth group G4 indicates the composite operation mode combined with the rotating state of the motor and the mode of the third group G3. The respective group modes are designated by the copy number setting ten keys. That is, when "10" is set by the ten keys, the mode "10" is designated. In this case, the states of the paper eject switch, the switch "SHT" for detecting the front edge of the manually fed paper, paper-separating miss detecting switch "SPMS", switch "SHEND" for detecting the rear edge of the manually fed paper, etc. are diagnosed, and when any of these switches are abnormal, any of "JAM", "TOF", "TOE", "CEMP", etc. is displayed correspondingly to the abnormal switches, and the abnormality is informed. These abnormal display is conducted by dividing the modes "10" to "13" into four sections, each of which is displayed by 4-bit data and processing them by the microprocessor 52. In the embodiment, when the selected signal is fed to the data selector, the selected signal is inputted from the copy number setting key. In this case the address of the input signal buffer memory provided in the RAM of the microcomputer may be designated directly by the copy number key, and the address may also be transferred to the display section.

The self-diagnosis flow will now be described in various modes in more detail with reference to the flow charts in FIGS. 14A to 16. Whether or not the ten keys is "10" is judged, when the ten keys are not "10", and whether or not the ten keys are "20" is judged, when the ten keys are not "20", whether or not the ten keys are "30" is judged. Thereafter, the composite operation confirmation routine is executed. When the ten keys are "30", the operation of the motor is confirmed, and when the ten keys are "31", the cleaner solenoid "BSL" is energized. The motor is energized after 0.1 sec. from the energization of the solenoid "BSL". Whether or not the ten keys are "32" is judged after 0.5 sec. therefrom, and when the ten keys are "32", the forward clutch "TSCL" is energized. When the ten keys are "33", the backward clutch "TBCL" is energized. When the ten keys are "34", the paper feeding solenoid "PFSL" is energized. When the ten keys are "35", the paper resupplying solenoid "PSSL" is energized. The manually-paper-feeding solenoid "SHSL" is energized by the ten key input "36", and when the ten keys input "37" is effective, the fixing solenoid "HSL" is energized. According to this composite operation confirmation routine, the propriety of the coupling operation of the rotation of the motor and the various solenoids and the clutches can be checked. For example, when the motor and the cleaning solenoid are energized, it is confirmed that the cleaning blade 20 is urged to the photoconductive drum 18 while the drum 18 is rotating, and the movement or stop of the document holding plate due to the operations of the document holding plate position detecting switch at the ordinary copying time when both the document holding plate driving clutch 31 and the motor 25 are energized can be confirmed.

The general operation of the diagnosis flow except that multi-operation diagnosis mode will now be described in more detail. When "20" is set by the ten keys, the diagnosis rountine of the third group G3 in FIG. 13 will be conducted. Similarly, the following operation will be executed by the numerals set by the ten keys.

21: Confirmation of the operation of the cleaner solenoid
22: Confirmation of the operation of the forward clutch
23: Confirmation of the operation of the backward clutch
24: Confirmation of the operation of the paper feeding solenoid
25: Confirmation of the operation of the paper resupplying solenoid
26: Confirmation of the operation of the manually paper feeding solenoid
27: Confirmation of the operation of the fixing solenoid.

Figure 15A:
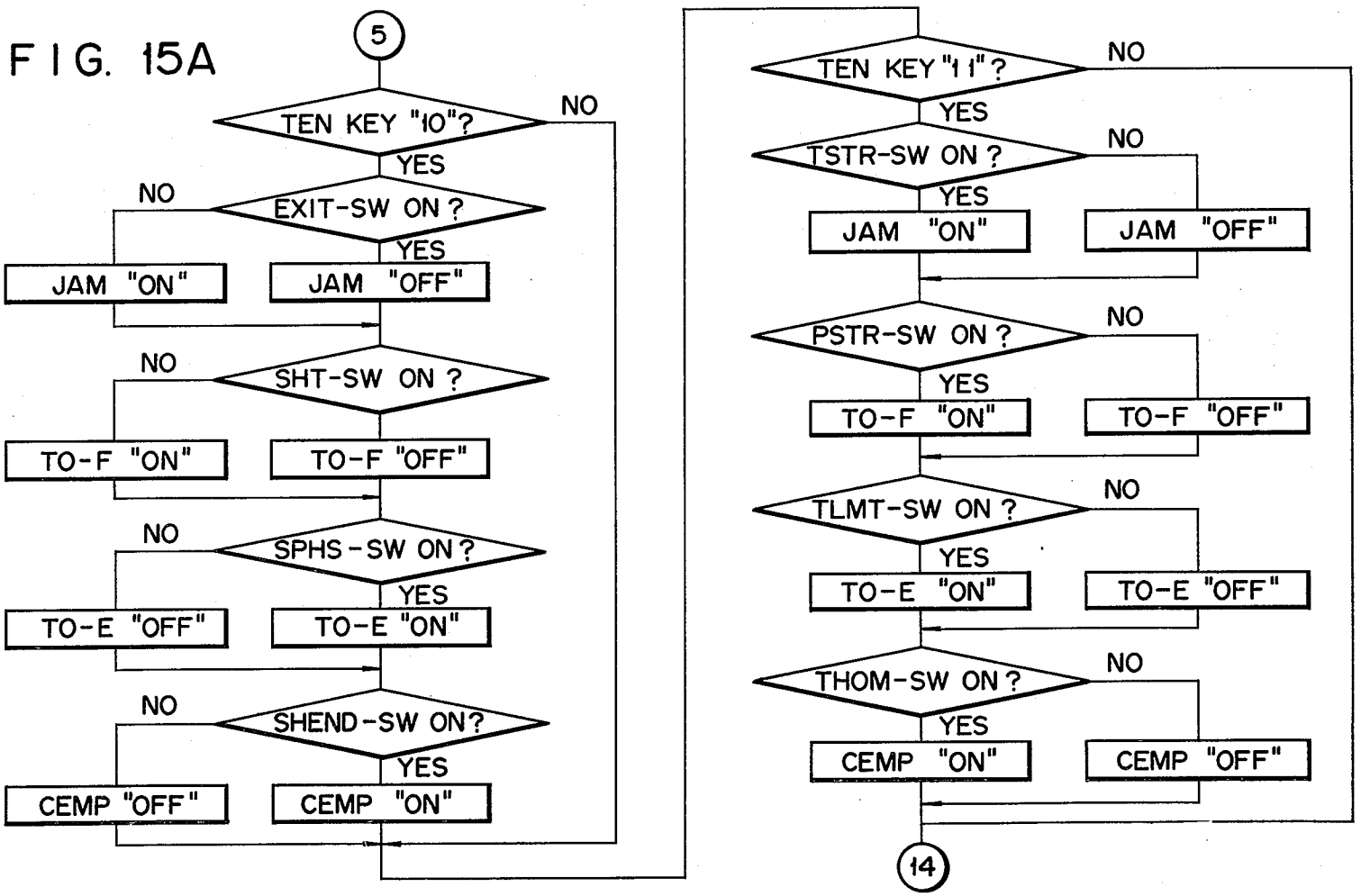
Figure 15B:
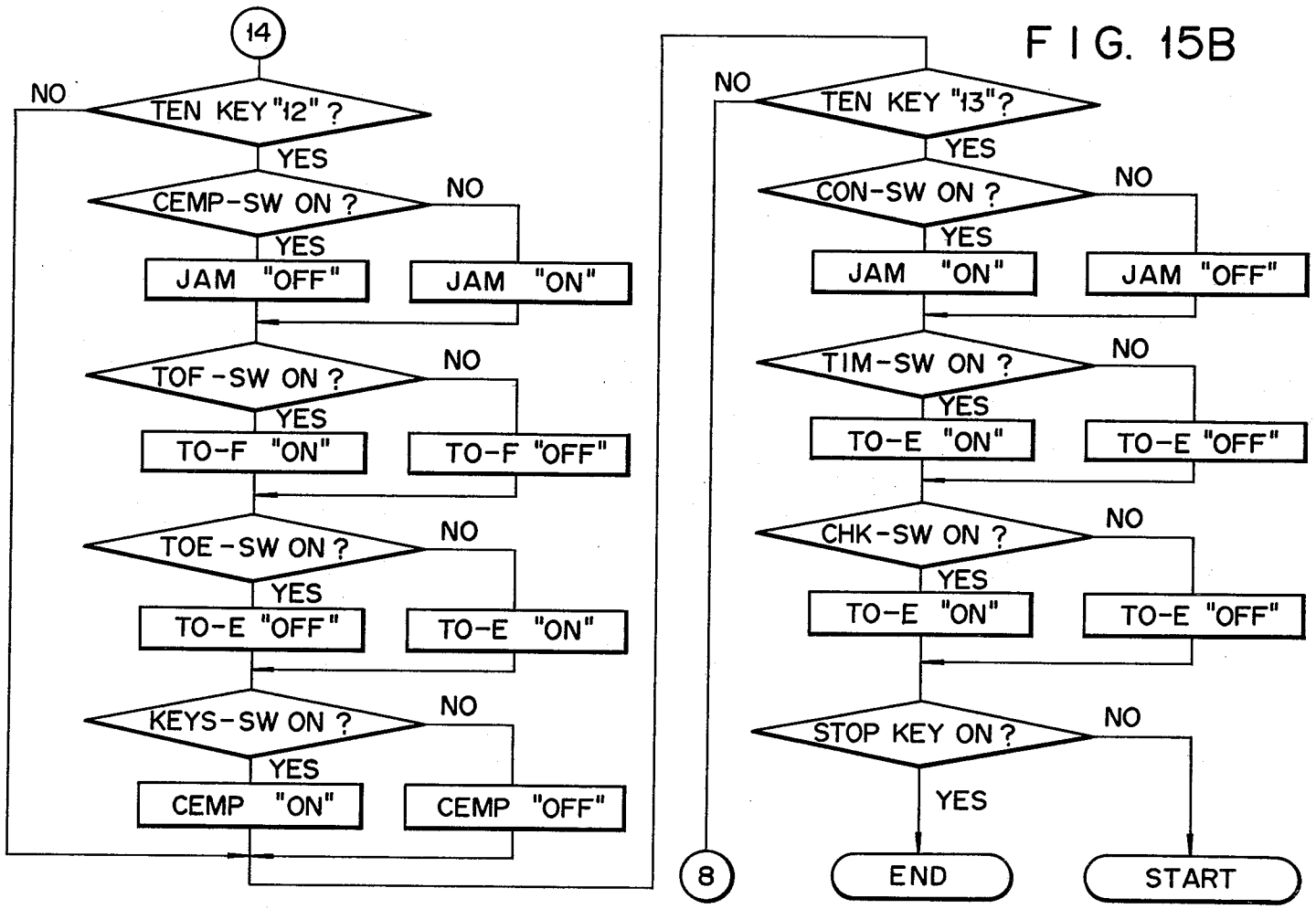
Figure 16:
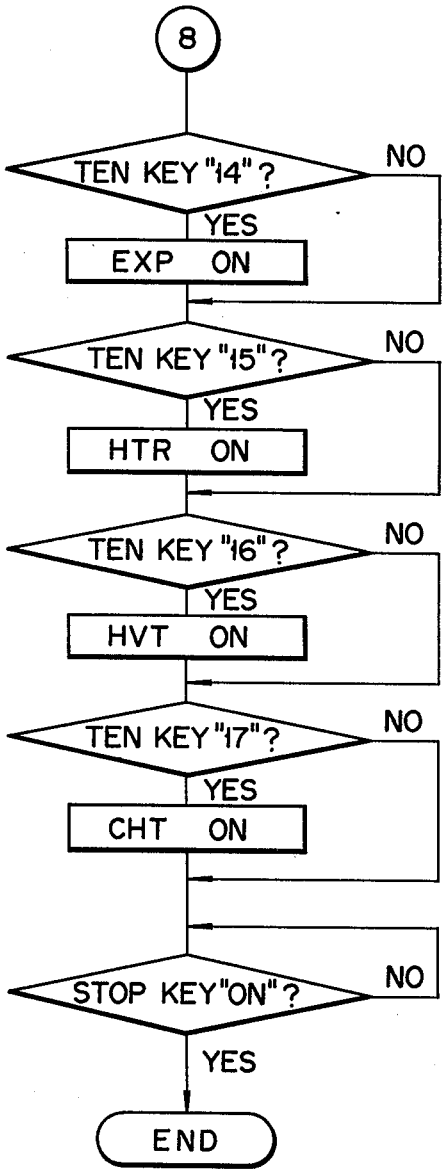

The first and second groups G1 and G2 in FIG. 13 are processed in accordance with the flow in FIGS. 15A, 15B and 16. More particularly, when "10" is set by the ten keys, the operations of the paper ejecting switch "EXIT", manually fed paper front end detecting switch "SHT", paper separating miss switch "SPMS", and manually fed paper rear end detecting switch "SHEND" will be sequentially confirmed. When any of these switches are inoperative, any of "JAM", "TOF", "TOE" and "CEMP" is energized correspondingly. When "11" is set by the ten keys, the operations of the table start switch "TSRT", paper start switch "PSTR", table limit switch "TLMT", and table home position switch "THOM" are sequentially confirmed. When any of these switches are inoperative, the corresponding lamp is energized. When "12" is set by the ten keys, the operations of the paper resupplying switch "CEMP" (the switch for detecting the rear end of the copy paper in the cassette), cleaner cleaning switch "TOF", toner resupplying switch "TOE", and key switch "KEYS" are sequentially confirmed. When "13" is set, the operations of the ageing switch "CON" (the switch for operating without passing copy paper), timer switch "TIM", and check switch "CHK" (the serviceman switch internally built in the apparatus) are sequentially confirmed. In the flow in FIG. 16, the following operations will be confirmed as to the set numbers "14" to "17".

14: Confirmation of the operation of the exposure lamp
15: Confirmation of the operation of the heater
16: Confirmation of the operation of the high voltage transformer "HVT" for the charger (separating, transferring and discharging chargers)
17: Confirmation of the transformer "CHT" for the charging charger.

The confirmation of the operations in the flow in FIG. 16 are visually executed as to whether the corresponding section or component is actually operated or not. Since the peripheral equipment of the lamp is heated in case of the continuously rated value in the exposure lamp energization routine, it is preferred to forcibly deenergize the lamp when the lamp is, for example, continuously energized for longer than 10 sec.

Figures 17, 18:
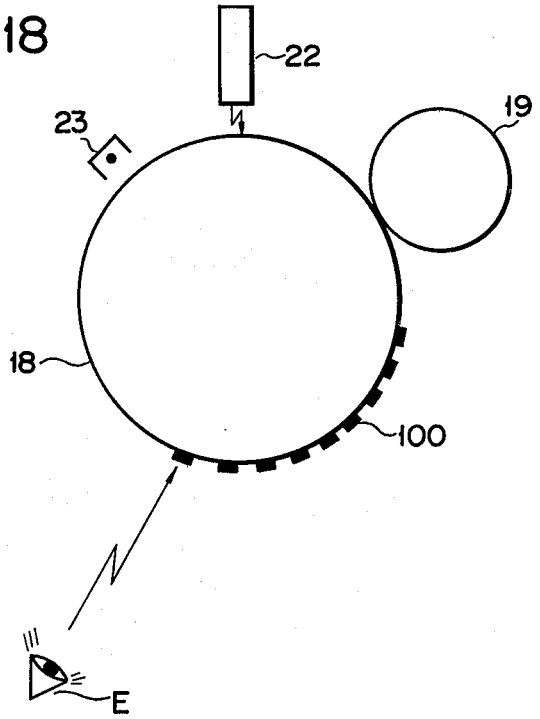
FIG. 17 is a view showing the other self-diagnosis mode.
FIG. 18 is a view showing the copying state when the self-diagnosis is executed in according to the self-diagnosis mode group in FIG. 17.
Figure 19A:
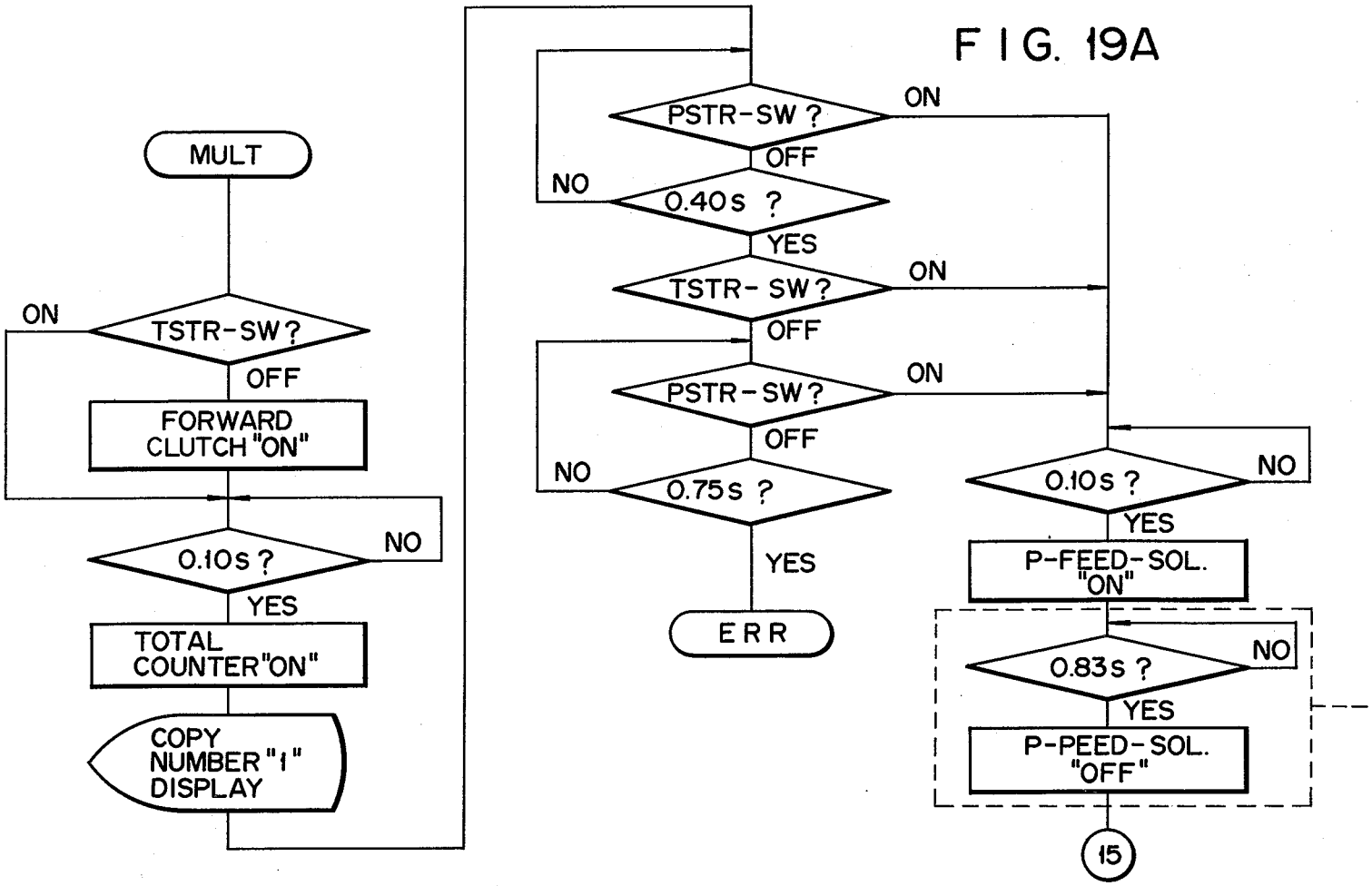
FIGS. 19A and 19B are flow charts for executing another mode.
Figure 19B:
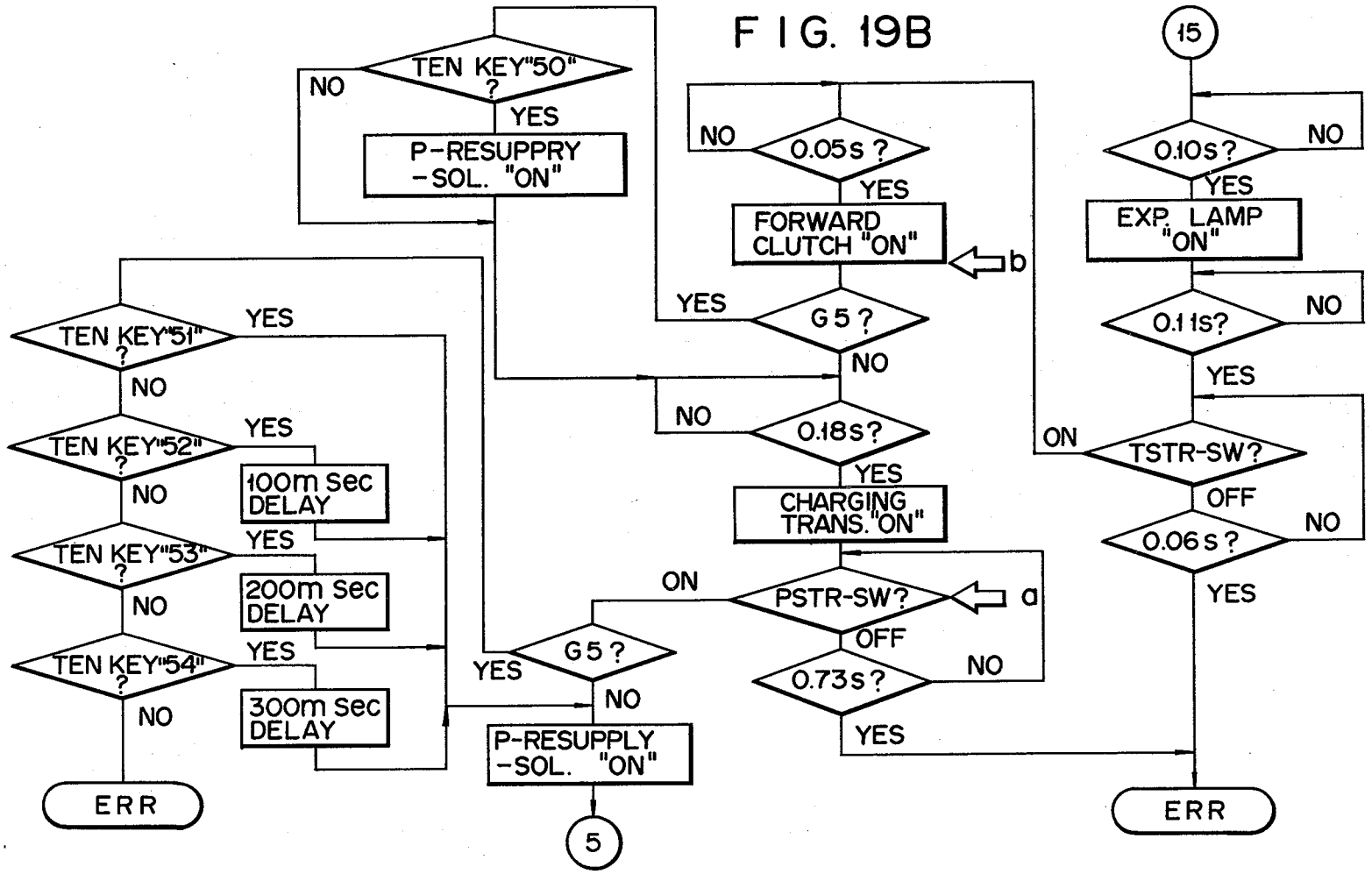

The embodiment of the self-diagonsis function relative to the image forming process will now be described with reference to FIGS. 17 and 18. The group G5 of the preset self-diagnosis mode indicates the mode for confirming the toner image formed on the photoconductive drum 18 by the serviceman. In this mode, the image forming process is stopped in the steps of charging, exposing and developing of the image forming process and the state before the transferring process is checked. When the mode "45" in FIG. 17 is selected, a toner image is formed for 0.5 sec. on the photoconductive drum by the developer 19, and the motor 25 is then stopped. The photoconductive drum is stopped when the end of the toner image is substantially arrived at the transfer position. The operating lever 30 shown in FIG. 1 is rotated in this state, and when the upper frame UF is, for example, released at 25°, the toner image can be observed. When the mode "30" is selected in the state that the upper frame UF is opened upwardly, the motor 25 is rotated, and the toner image can be confirmed on the photoconductive drum 18 in the rotating direction. In order to confirm the cleaning state of the photoconductive drum, the toner image may be formed in advance in the above mode, and the motor 25 and the cleaning device 20 may be operated in the mode "31". The operations of the respective sections and the components may not only be confirmed in combination of the respective modes, but also the combination of various modes may be set in advance by programming the combination of the various modes and may be performed.

In FIG. 18, the photoconductive drum 18 is charged at a predetermind potential by the charger 23. An image of the document placed on the document holding plate 11 is projected via the light transmission member 22 on the charged photoconductive drum 18, the photoconductive drum 18 is then exposed, and an electrostatic latent image is formed on the photoconductive drum 18. This latent image is developed with the toner by the developer 19 on the drum as a toner image. Although the transfer step is executed in the ordinary copying step after the development, the toner image is moved until the toner image 100 is visually confirmed in the state that the image forming device is opened in this mode, and the toner image is stopped at the confirmed position.

The function of diagnosing the improper front and back image edge portions will now be described in more detail with reference to FIGS. 19A, 19B, 20, 21A and 21B. The timing of energizing the paper resupplying solenoid in the ON-timing (in the flow a of the flow chart in FIG. 19B) of the paper start switch (P-STR-SW) is changed as below in the self-diagnosis mode. More particularly, when the mode "50" is, for example, selected, the energizing timing of the resupplying solenoid is set after the energizing timing of the forward clutch (in the flow b in FIG. 19B). This timing is set by the program. When this timing is thus set, the copy paper front edge will arrive at the transfer device 15 approx. 100 mm faster than the front edge position of the toner image formed on the photoconductive drum 18. The front edge of the toner image can be transferred to the copy paper in this manner, and accordingly the rising timing of the charging and exposure can be confirmed. As shown in FIGS. 21A and 21B, the toner image 200 becomes smoothly dark in response to the rise of the charger 23 and the optical system or illuminator 21 from the charging start position SC to exhibit the density corresponding to the image of the document in the document front edge portion SP. In the ordinary copy mode "51", the front edge SP of the document is transferred when the front edge SP of the document coincides with the front edge of the copy paper P, the portion from the charging start point SC to the document front edge SP is guided to and cleaned by the cleaning device 20. When the diagnosis mode "50" is executed, the copy paper P is arrived at the transfer device 15 earlier than normal state, the toner image from the charging start point SC is transferred to the copy paper, the toner image can be thus observed as a copy image, and the front edge position of the image can be diagnosed in this manner.

When a large quantity of toner image is formed on the untransferred portion, e.g., the portion from the charging start point SC to the document front edge P, an improper image due to improper cleaning, excessive toner consumption, or the like occurs. When there is no toner image on the untransferred portion, a scratch feasibly occurs on the photodconductive drum 18, for example, in case of the blade cleaning. Accordingly, in order to obtain an optimum toner image on the untransferred portion, the untransferred portion is confirmed by the diagnosis mode, the operation timing of the charger 23 is controlled, and the lighting timing of the exposure lamp of the optical system 21 is controlled.

With respect to the document rear edge the conveyance of the copy paper is, for example, delayed from the mode "54" contrary to the above-described timing, and the energizing timing of the charger 23 may be controlled. The ON-timing of the paper start switch (P-STR-SW) is finely delayed in the diaganosis mode, and the criterion of the position controls with the image front edge and the document front edge can be obtained for facilitating the maintenance and adjustments.

Since the interior of the copying apparatus can be self-diagnosed only by the program processing without increasing the circuit arrangements according to the present invention as the foregoing description, the check and maintenance of the copying apparatus can be readily and rapidly performed. Inasmuch as the serviceman switch can be operated with the mode switching means and the copy number setting ten keys can be utilized as the diagnosis mode setting means, the operability and the workability of the copying apparatus become excellent.

In the embodiments described above, the symbols for indicating the operating states are set at every switch group when confirming the operation of the switches, but the operating states may be indicated directly. For example, the data of the operating states may be numerically displayed by 7-segment LED of the copy number display.

What is claimed is:

1. An image forming apparatus comprising:

document holding means for holding a document;

a rotatable photoconductive drum;

charging means for charging said photoconductive drum;

exposure means for exposing said photoconductive drum to form an electrostatic latent image corresponding to the pattern of said document placed on said photoconductive drum;

a developer for converting said electrostatic latent image into a toner image;

means for transferring the toner image onto a copy paper;

a plurality of driving elements for driving said photoconductive drum, charging means, exposure means, developer and transferring means;

microprocessor means having memory means for storing programs for executing a variety of diagnosis modes including combination check modes for checking the operation of at least two of said driving elements, and an image forming process mode;

means for designating the mode to be executed; and said microprocessor means causing at least two driving elements to operate in accordance with the combination check mode designated by said designating means.

2. The image forming apparatus according to claim 1, wherein said document holding means includes a document table on which the document is placed and document table driving means for moving said document table, and which includes table position detecting means for detecting a start position, a home position and a limit position of said document table and for producing position signals representing said start, home and limit positions, said microprocessor means operating said document table driving means in response to the position signals.

3. The image forming apparatus according to claim 1, wherein said mode designating means is a keyboard having ten keys by which the number corresponding to each of the modes is designated.

4. The image forming apparatus according to claim 1, wherein said table position detecting means comprises reed switches arranged respectively at the start, home and limit positions of said document holding table and a magnet mounted on said document holding table for operating said reed switches.

5. The image forming apparatus according to claim 1, wherein said document holding table is forwarded in response to a signal representing the start position of the document holding table, is stopped at the home position in response to a signal representing the home position, and is backwarded in response to a signal representing the limit position.

6. The image forming apparatus according to claim 1 wherein said diagnosis modes include check modes for checking the operation of switches used in the apparatus, transformer check modes for checking the operation of transformers used in the apparatus, clutch and solenoid check modes for checking the operation of clutches and solenoids used in the apparatus, and motor check modes for checking the operation of motors used in the apparatus, each of said combination check modes being used to execute each clutch and solenoid mode and each motor check mode.

7. The image forming apparatus according to claim 1, wherein said diagnosis modes include front image edge check modes which are executed, whereby a toner image is transferred to a copy paper from the charging start point of said photoconductive drum so that the front image edge portion of the toner image is subjected to visual examination.

* * * * *